US007624784B2

(12) United States Patent
Anthony et al.

(10) Patent No.: US 7,624,784 B2
(45) Date of Patent: Dec. 1, 2009

(54) SEGMENTED ROLL UP COVERING FOR ARCHITECTURAL OPENINGS

(75) Inventors: James M. Anthony, Denver, CO (US); Kristi K. Kopecky, Westminster, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 579 days.

(21) Appl. No.: 11/413,802

(22) Filed: Apr. 28, 2006

(65) Prior Publication Data

US 2007/0251652 A1 Nov. 1, 2007

(51) Int. Cl.
*A47H 1/00* (2006.01)

(52) U.S. Cl. ..... 160/120; 160/166.1; 160/176.1 R; 160/84.01

(58) Field of Classification Search ..... 160/89, 160/84.01, 84.03, 120, 243
See application file for complete search history.

(56) References Cited

U.S. PATENT DOCUMENTS

| | | | | | |
|---|---|---|---|---|---|
| 55,907 | A * | 6/1866 | Read | 160/243 |
| 179,123 | A | 6/1876 | McGill | |
| 1,181,120 | A * | 5/1916 | Douthitt et al. | 160/243 |
| 1,847,077 | A * | 3/1932 | Boeck | 160/133 |
| 1,858,684 | A * | 5/1932 | Pratt | 160/133 |
| 2,207,420 | A | 7/1940 | Thomas | |
| 2,336,899 | A * | 12/1943 | Stern | 160/243 |
| 4,433,711 | A | 2/1984 | Lew | |
| 5,443,923 | A | 8/1995 | Laniado et al. | |
| 5,566,735 | A * | 10/1996 | Jelic | 160/84.04 |
| 5,649,583 | A * | 7/1997 | Hsu | 160/84.05 |
| 5,787,951 | A | 8/1998 | Tonomura et al. | |
| 6,367,537 | B1 * | 4/2002 | Hsu | 160/243 |
| 6,860,312 | B2 * | 3/2005 | Judkins | 160/243 |
| 6,988,526 | B2 * | 1/2006 | Judkins | 160/84.01 |
| 7,124,802 | B2 * | 10/2006 | Sudano | 160/89 |
| 7,353,856 | B2 * | 4/2008 | Pon et al. | 160/120 |
| 2004/0040673 | A1 | 3/2004 | Jelic | |

(Continued)

FOREIGN PATENT DOCUMENTS

| | | |
|---|---|---|
| DE | 36 22 696 A1 | 1/1988 |

(Continued)

*Primary Examiner*—Katherine W Mitchell
*Assistant Examiner*—Jaime F Cardenas-Garcia
(74) *Attorney, Agent, or Firm*—Dorsey & Whitney LLP

(57) ABSTRACT

A covering for an architectural opening includes a roller assembly having a rotatable roller secured to one edge of a sheet of flexible material with the opposite edge secured thereabove to a fixed location. The roller assembly is cradled in a cord ladder or cord ladder type element so one vertical run of the cord ladder is anchored and the other vertical run is raised or lowered to raise and lower the cradle thereby causing the flexible material to be wrapped around or unwrapped from the roller. The roller assemblies can be used individually or in combination with like roller assemblies and can further be used in combination with other covering products such as sheets of translucent or transparent materials like sheer fabric. In addition to being able to roll and unroll the strips of flexible material onto or from their associated rollers, an entire assemblage of such roller assemblies can be raised or lowered with a closed loop lifting system that raises a bottom rail and accumulates each roller assembly thereabove to any desired degree between a fully extended position and a fully retracted position.

25 Claims, 21 Drawing Sheets

U.S. PATENT DOCUMENTS

| | | | | |
|---|---|---|---|---|
| 2004/0060670 | A1* | 4/2004 | Judkins | 160/243 |
| 2004/0154754 | A1* | 8/2004 | Judkins | 160/84.01 |
| 2004/0159408 | A1* | 8/2004 | Smith et al. | 160/84.01 |
| 2004/0231805 | A1* | 11/2004 | Sudano | 160/89 |
| 2005/0155720 | A1* | 7/2005 | Nien et al. | 160/84.01 |
| 2005/0155721 | A1* | 7/2005 | Pon | 160/84.01 |
| 2007/0251652 | A1* | 11/2007 | Anthony et al. | 160/84.04 |

FOREIGN PATENT DOCUMENTS

| | | | |
|---|---|---|---|
| DE | 38 36 595 | A1 | 10/1989 |
| DE | 295 05 142 UI | | 8/1995 |
| DE | 195 17 552 | A1 | 11/1996 |
| GB | 1 494 842 | | 12/1977 |
| JP | 7-039449 | A | 2/1995 |
| JP | 9-221969 | A | 8/1997 |
| JP | 9-296666 | A | 11/1997 |
| JP | 10-018736 | A | 1/1998 |
| JP | 10-018737 | A | 1/1998 |

* cited by examiner

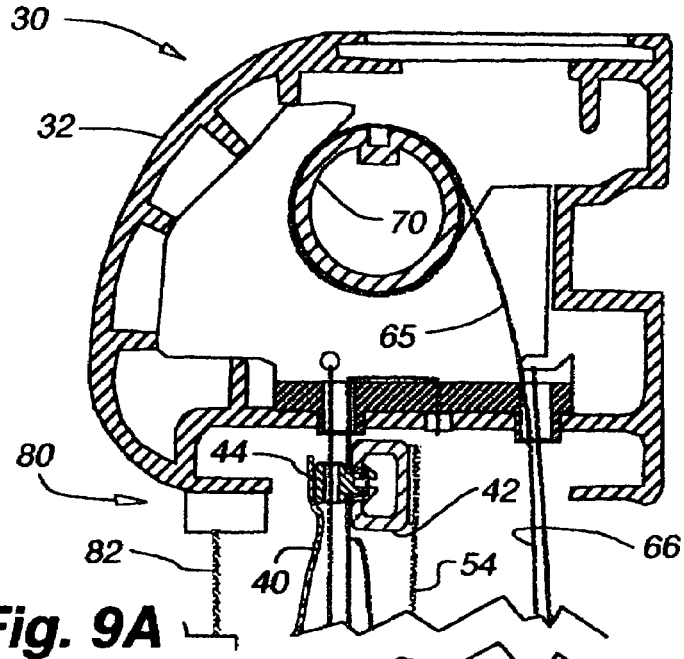
Fig. 9A
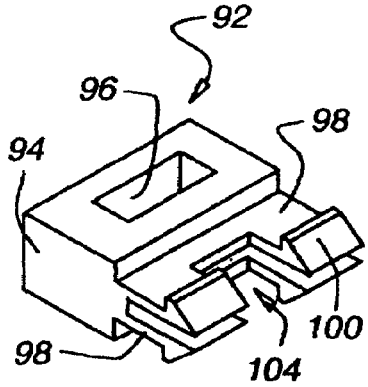
Fig. 9G
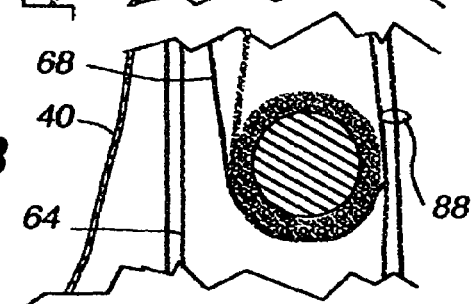
Fig. 9B
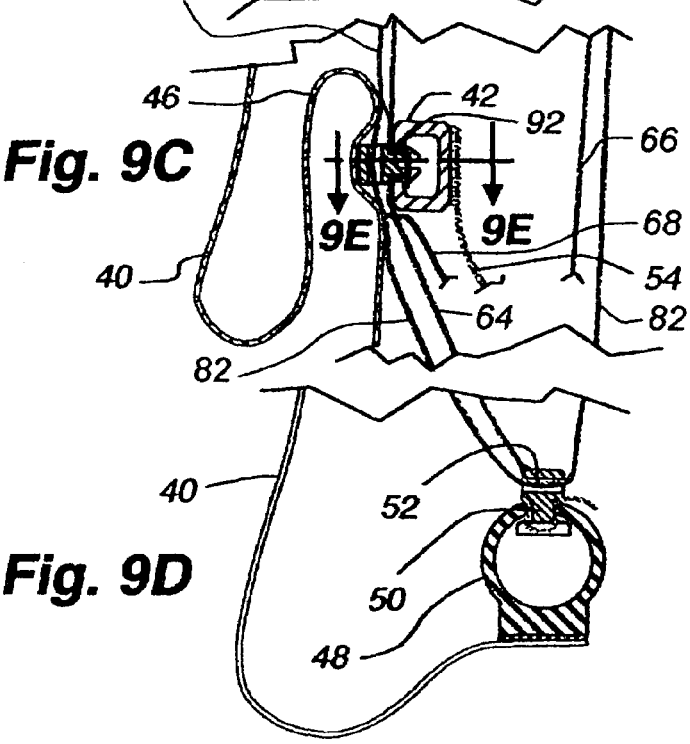
Fig. 9C
Fig. 9D
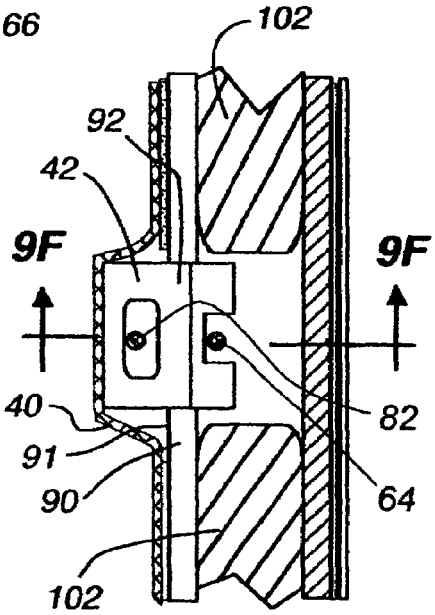
Fig. 9E
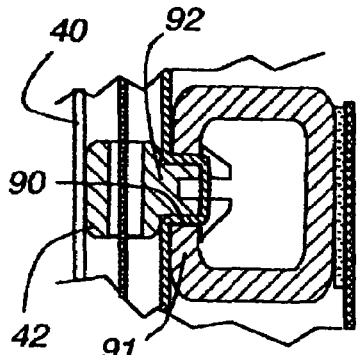
Fig. 9F

SEGMENTED ROLL UP COVERING FOR ARCHITECTURAL OPENINGS

BACKGROUND OF THE INVENTION

1. Field of the Invention

The present invention relates generally to coverings for architectural openings such as windows, doors, archways, and the like, and more particularly to a retractable shade-type covering wherein one or more roller assemblies have a strip of flexible material anchored along one edge and secured along an opposite edge to an associated roller so the strip of material can be rolled about the roller to retract the covering or unrolled to extend the covering. A plurality of such roller assemblies can be provided in adjacent vertically spaced relationship or the roller assemblies can be aggregated with other covering components, such as a large sheet of transparent or translucent material, in a manner such that the entire covering can be extended or retracted independently of the individual roller assemblies.

2. Description of the Relevant Art

Retractable coverings for architectural openings such as windows, doors, archways, and the like, have been used for many years. Examples of such covers are curtains, roll-up shades, venetian blinds, vertical blinds, cellular shades, and the like. Most such retractable coverings utilize one panel of material that is extended entirely across the architectural opening or retracted therefrom or in the case of vertical blinds, curtains, or draperies, there may be two panels of material that are anchored adjacent opposite sides of the architectural opening so they can be extended toward each other or retracted back to the respective sides of the opening.

There are also examples of segmented roll-up coverings for architectural openings with an example of such being in U.S. application Ser. No. 10/607,371 entitled Modular Framed Covering for Architectural Openings, filed Jun. 25, 2003, which is of common ownership with the present application. A segmented covering of this type has a plurality of relatively small strips of flexible material independently associated with rollers which are driven in unison to roll the strip material thereabout or unroll the sheet material from the roller when moving the covering between retracted and extended positions. The rollers are rotated by a drive system including a belt operatively associated with each roller and orbitally driven by a manual slide member to extend and retract the various segments of the covering.

Another example of a segmented covering for an architectural opening is disclosed in U.S. Pat. No. 179,123 where individual rollers are associated with independent strips of material in a manner such that all of the strips may be lifted by one control system or the shades can be independently rolled or unrolled relative to their associated rollers by another control system. The two control systems utilize cords wrapped around the individual rollers for operation of the covering.

It is to provide an improvement in retractable coverings for architectural openings that the present invention has been developed.

SUMMARY OF THE INVENTION

In the retractable covering of the present invention, a single roller assembly or preferably a plurality of such roller assemblies are utilized to form a panel wherein each roller assembly includes a strip of flexible material and an associated roller about which the material can be wrapped. One edge of the flexible material is fixed to a relatively rigid bar or is otherwise supported while the opposite edge is secured to its associated roller. The roller with the flexible material secured thereto is cradled in one of a plurality of cradles provided in a first lift system which includes a cord ladder or similar structure so that upon movement of one vertical run of the cord ladder between an elevated and a lowered position while the other vertical run remains stationary, the cradle is raised or lowered thereby lifting or lowering the roller causing it to roll and either roll the fabric thereabout or unroll the fabric therefrom depending upon the direction of rotative movement of the roller. A second lift system is movable between retracted and extended positions and gathers all of the roller assemblies in the retracted position so they are positioned immediately beneath a head rail or lowers the roller assemblies so they are vertically spaced and supported by the head rail.

As will be appreciated, the first lift system simultaneously raises or lowers each roller assembly suspended therefrom so its associated flexible strip of material can be extended or retracted across a designated portion of the architectural opening. A second covering component or panel could also be suspended from the head rail in front of or behind the roller assemblies. The second covering component or panel could, by way of example, include a continuous sheet of material, such as sheer fabric, that is draped in a roman shade-type configuration or extended in a flat plane across the entire opening.

According to the above, the covering might include two components or panels extended across the architectural opening in tandem with one component or panel being the aggregate of the roller assemblies, which in combination can extend across the entire architectural opening and the other component or panel the continuous sheet of material. As will be appreciated, the strips of material associated with the roller assemblies can be retracted about their associated rollers so that vision through the covering is only through the sheet of material comprising the second component of the covering, which is usually transparent or translucent. In another position of the covering, it can be fully retracted with both covering components or panels retracted or, in still another position, both of the covering components or panels can be fully extended or finally both covering components can be partially extended.

Other aspects, features and details of the present invention can be more completely understood by reference to the following detailed description of a preferred embodiment, taken in conjunction with the drawings and from the appended claims.

BRIEF DESCRIPTION OF THE DRAWINGS

FIG. 9A is an enlarged fragmentary section taken along line 9A-9A of FIG. 2.

FIG. 9B is an enlarged fragmentary section taken along line 9B-9B of FIG. 2.

FIG. 9C is an enlarged fragmentary section taken along line 9C-9C of FIG. 2.

FIG. 9D is an enlarged fragmentary section taken along line 9D-9D of FIG. 2.

FIG. 9E is an enlarged fragmentary section taken along line 9E-9E of FIG. 9C.

FIG. 9F is an enlarged fragmentary section taken along line 9F-9F of FIG. 9E.

FIG. 9G is an isometric of the cord clip.

DESCRIPTION OF THE PREFERRED EMBODIMENTS

Figure 1:
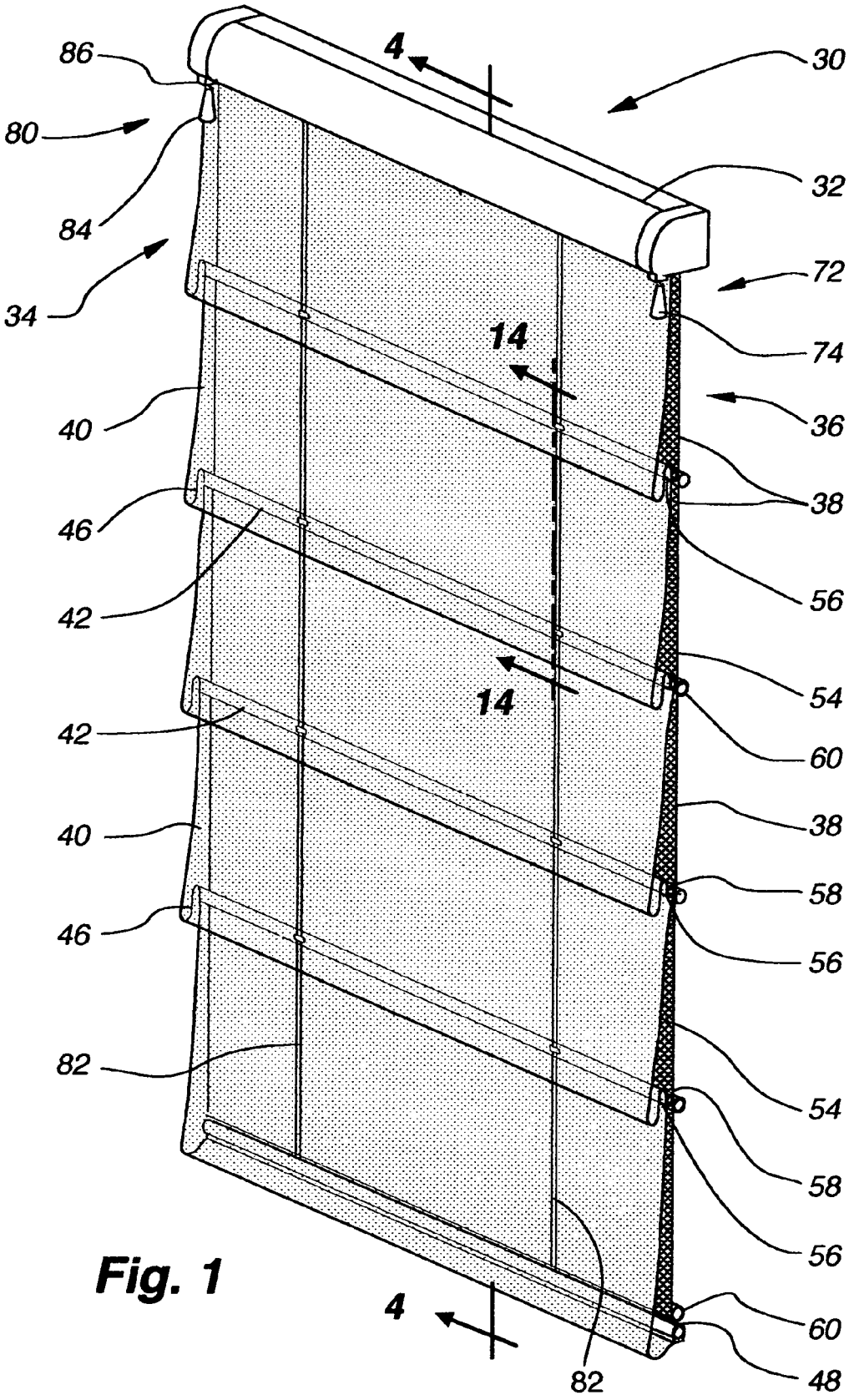
FIG. 1 is an isometric of the covering of the present invention with both the front panel and the rear segmented panel in a fully extended position.
Figure 2A:
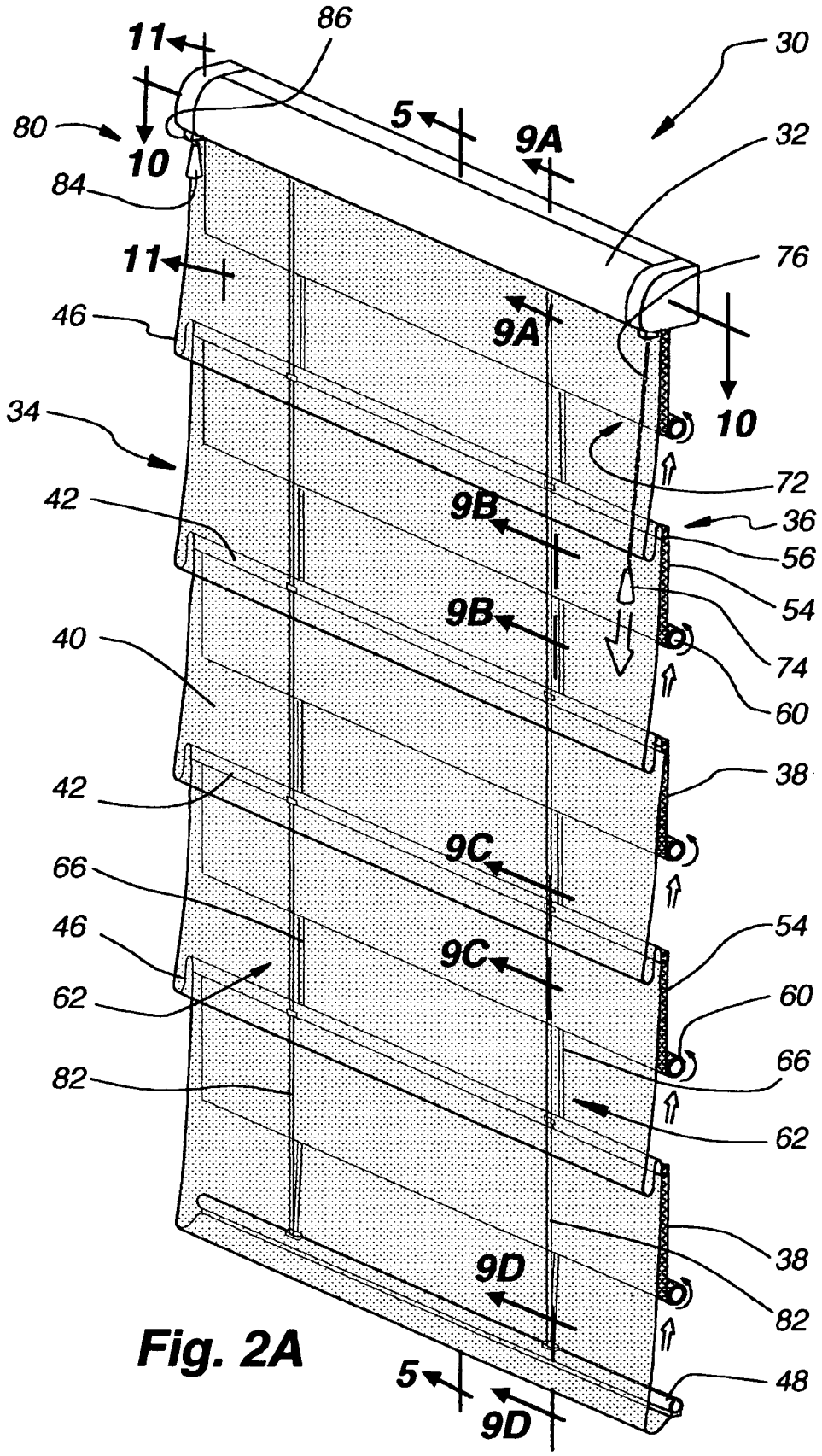
FIG. 2 is an isometric similar to FIG. 1 with the front panel fully extended and the rear segmented panel partially retracted.
Figure 2B:
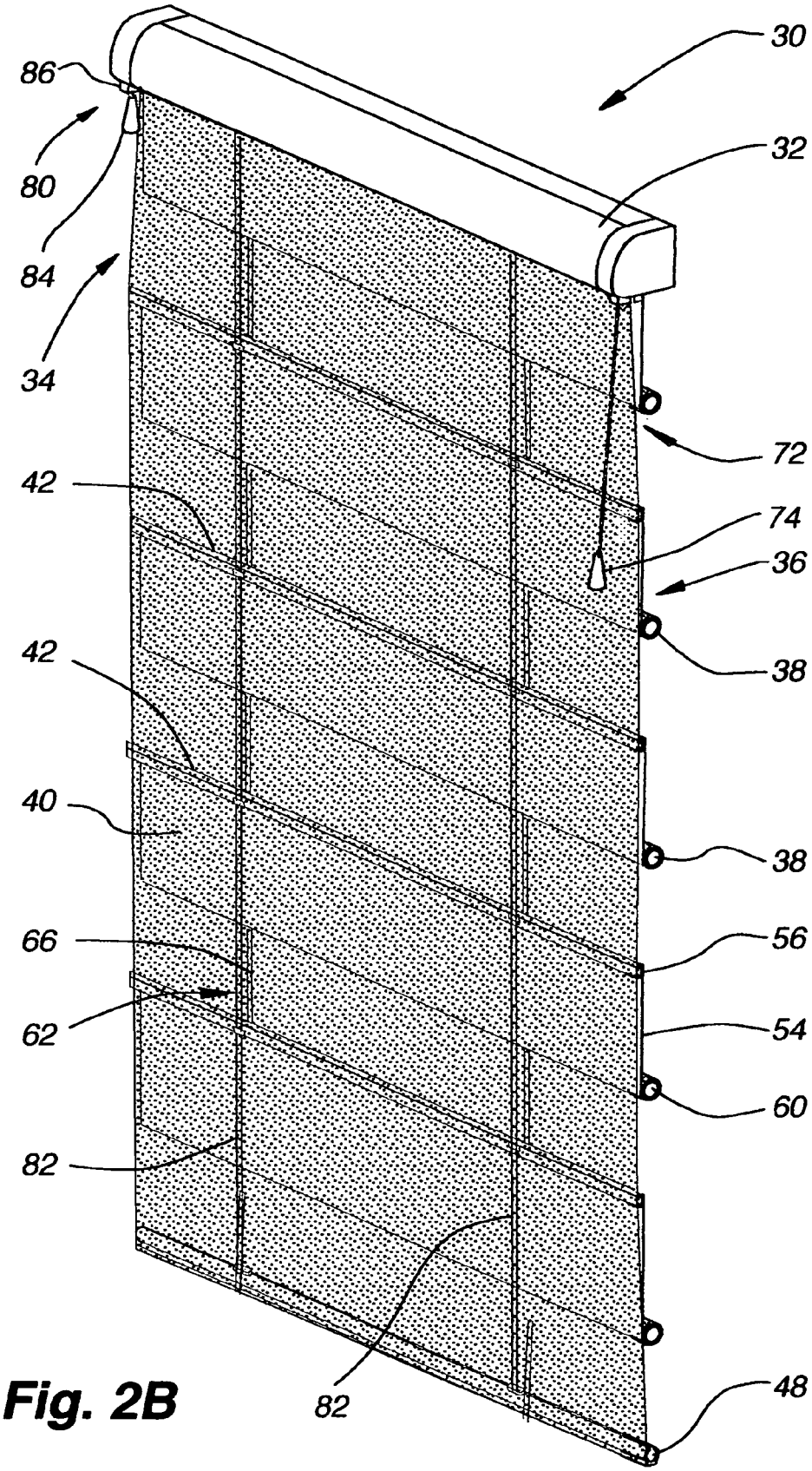
Figure 3:
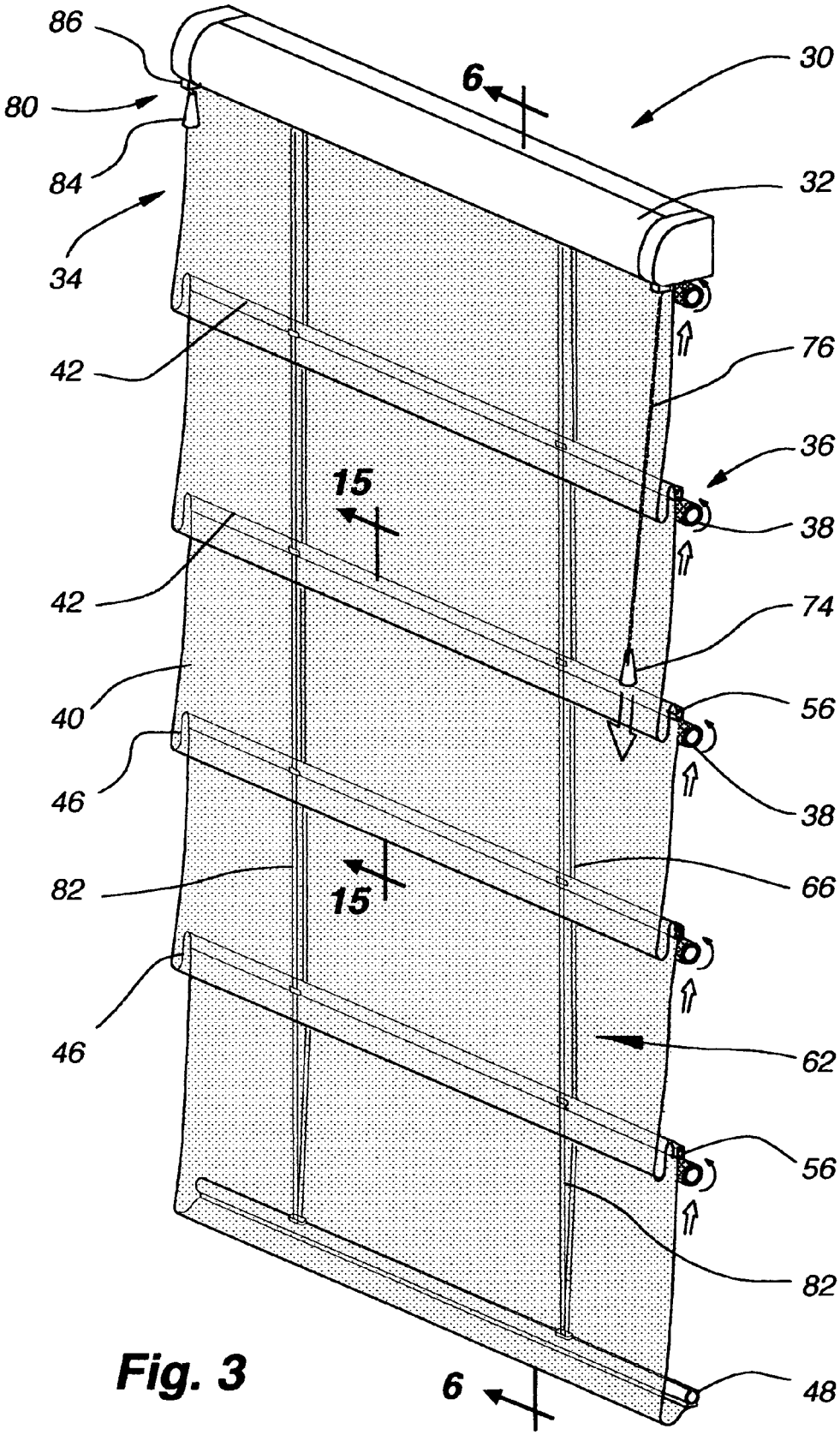
FIG. 3 is an isometric similar to FIGS. 1 and 2 with the front panel fully extended and the rear segmented panel fully retracted.
Figure 4:
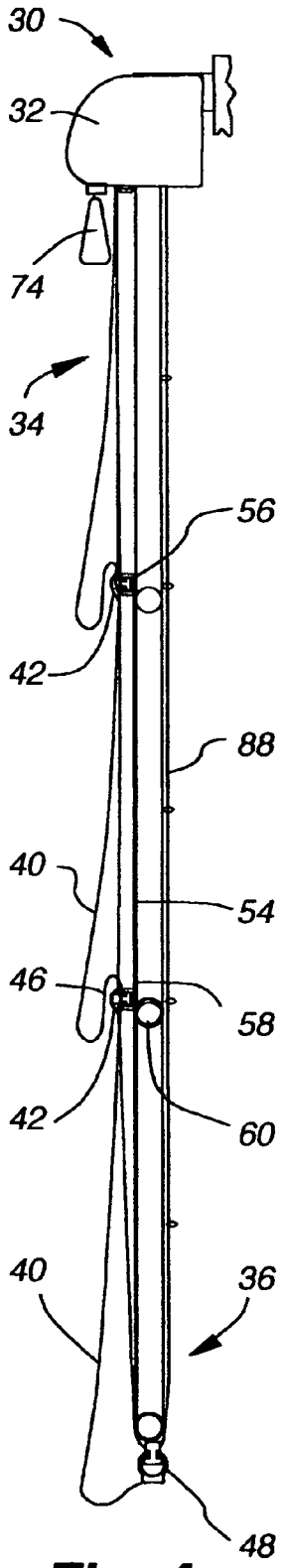
FIG. 4 is a diagrammatic section taken along line 4-4 of FIG. 1.
Figure 5:
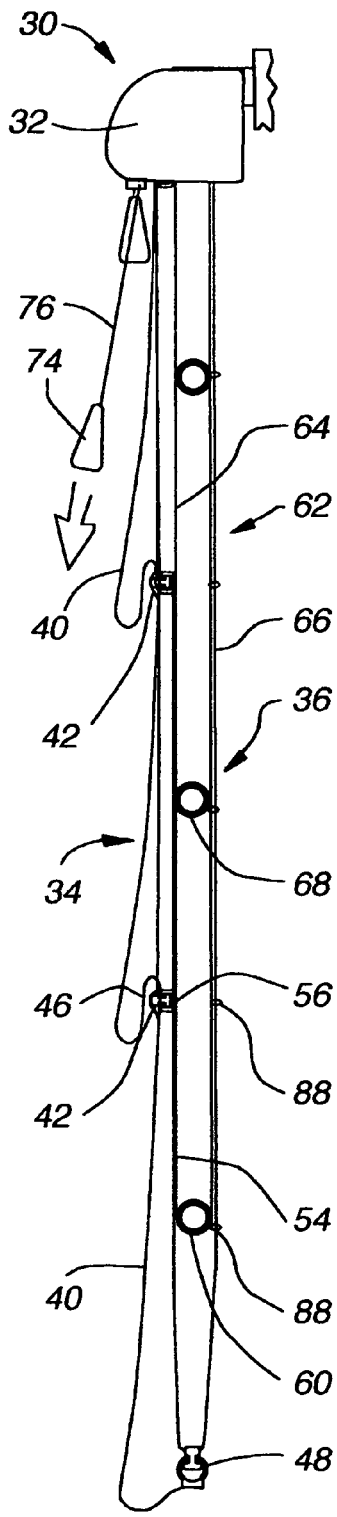
FIG. 5 is a diagrammatic section taken along line 5-5 of FIG. 2.
Figure 6:
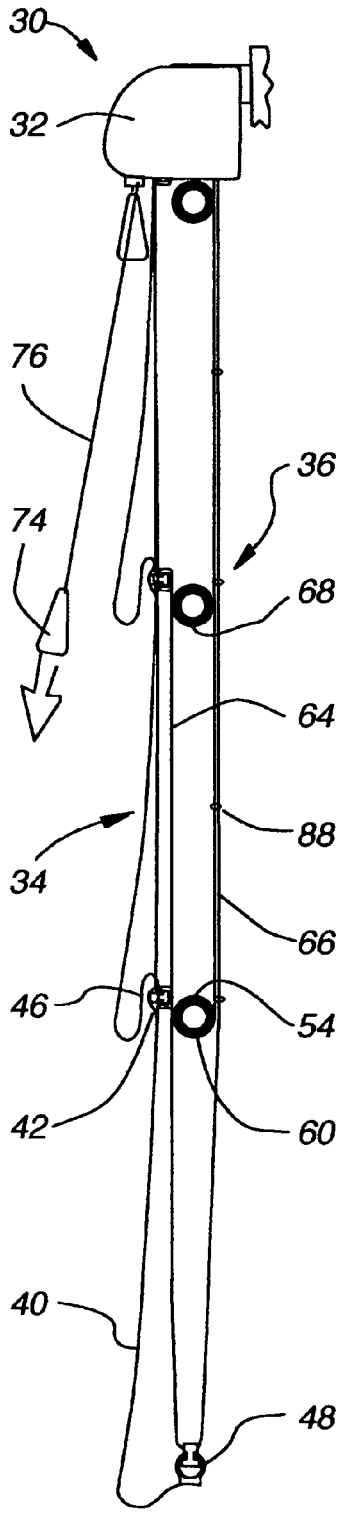
FIG. 6 is a diagrammatic section taken along line 6-6 of FIG. 3.

With reference first to FIGS. 1-3, the covering 30 of the present invention can be seen to include a head rail 32 from which is suspended a front covering component 34 and a rear covering component 36 of roller assemblies 38. For purposes of the present description, the front covering component would face the interior of the building structure in which the covering is mounted even though the system could be reversed so the roll-up assembly component could face the interior of the building structure.

Also for purposes of the present disclosure, the roller assemblies 38 in combination will be referred to hereinafter as a segmented covering component of the covering of the present invention even though the segmented covering component, which includes a plurality of roller assemblies, could comprise a single roller assembly as will be appreciated with the description that follows.

It will be made clear with the description hereafter the covering 30 could assume numerous different positions. One position is illustrated in FIG. 1 wherein both the front covering component 34 and the segmented covering component 36 are fully extended. A second position is shown in FIG. 2 where the front covering component 34 is fully extended and the segmented covering component 36 is partially extended while moving toward a fully retracted position as shown in FIG. 3. A fourth position shown in FIG. 7 has both the front covering component and the segmented roller component fully retracted in stacked relationship immediately adjacent to the underside of the head rail 32. There are obviously many other positions between fully extended or fully retracted the covering could assume.

The front covering component 34 is shown best in FIGS. 1-8 to comprise a flexible sheet 40 of transparent or translucent material such as, for example, a sheer fabric. The front covering component could, however, as an alternative comprise a plurality of vertically extending support cords, rails, tapes, microfibers, or the like. The front covering component, as will be appreciated with the description hereafter, serves to support a plurality of horizontal, vertically spaced rigid or semi-rigid battens 42 and, accordingly, the front covering component should be substantially non-extensible so as to reliably retain the battens in a predictably fixed relationship with each other and relative to the overall covering 30.

In the first disclosed embodiment of the invention as seen best in FIGS. 1, 2A, and 3-7, the front covering component 34, as mentioned previously, includes a sheer fabric 40 which depends from a top anchor rail 44, which may be an uppermost batten, secured within the head rail 32 and is suspended so as to hang downwardly and pass through a plurality of reverse horizontal loops 46 so as to simulate a roman shade. Each reverse loop is positioned approximate to a batten 42 and the sheer is connected to the batten in any suitable manner such as with adhesive, ultrasonic bonding, a hook-and-loop-type fastener such as Velcro, or the like. The reverse loops are for aesthetics so the sheer fabric could simply be a straight hanging sheet as shown in FIGS. 2B and 8. The bottom edge of the sheer fabric is secured to a ballast bar or bottom rail 48 in any suitable manner such as with adhesive, ultrasonic bonding, hook-and-loop fasteners, or the like. The bottom rail has a pair of horizontally spaced brackets 50 with holes 52, as seen in FIGS. 8 and 9D, therethrough for a purpose to be described hereafter.

Again with reference to FIGS. 1-8, the segmented roller assembly or rear covering component 36 of the covering 30 consists of a plurality of sequentially arranged, vertically spaced, horizontally disposed roller assemblies 38 which are identical. Each roller assembly has a strip or shade element 54 of horizontally disposed flexible material such as a translucent or opaque fabric or some combination of fabrics with the top edge 56 of each strip of material being anchored to an associated batten 42 in a manner to be described later. Its lower or first edge 58 is secured to a roller or stiffener in the form of a rod or bar 60 so the strip of material can be rolled about or unrolled from the roller during operation of the covering. Each strip has a length (horizontal dimension as illustrated) and a width with the length being greater than the width. To assist in rolling the strip about the roller, the strip might be pretreated to have a coil bias which would encourage it to roll about the roller, but such a bias is not mandatory.

Each roller 60 is supported by two or more identical conventional cord ladders 62 of the type used in venetian blinds and the like. The cord ladders could, as an alternative, be tape ladders 63 (FIG. 16E) wherein the cords are replaced with tapes or flexible strips of a fabric material 65 as is also commonly found in venetian blinds and similar products. The cord ladders 62 have a front vertical run or rail 64 adjacent to the front covering component 34, a rear vertical run or rail 66 near the rear of the covering 30, and a plurality of vertically spaced generally horizontally disposed rungs 68 interconnecting the front and rear vertical runs which are used to support or cradle a roller assembly 38.

As will be appreciated with the description of the covering hereafter, the front run 64 of each cord ladder 62 is fixed to the battens 42 so when the front covering component 34 is fully extended as shown in FIGS. 1-3, the front runs of the cord ladders are fully extended. The rear vertical runs extend adjacent to the rollers 60. The rear run 66 of each cord ladder is suspended from a take-up roller or shaft 70 (FIGS. 8 and 9A) in the head rail 32 which can be reversibly rotated with a first control cord system 72 having a manually operable tassel 74 connected to a drive, lift or tilt cord 76 for rotating the take-up roller in a counterclockwise direction as viewed in FIG. 9A. When the roller 70 is rotated in a counterclockwise direction, the roller partially wraps the associated rear vertical runs 66 of the cord ladders thereabout thereby raising the rear edge of each rung 68 of the cord ladders until the rungs are moved from a very tilted or near vertical rearwardly declined orientation as shown in FIG. 14 to a substantially horizontal drooped orientation as shown in FIG. 15 when the segmented covering component 36 is fully retracted.

Figure 14:
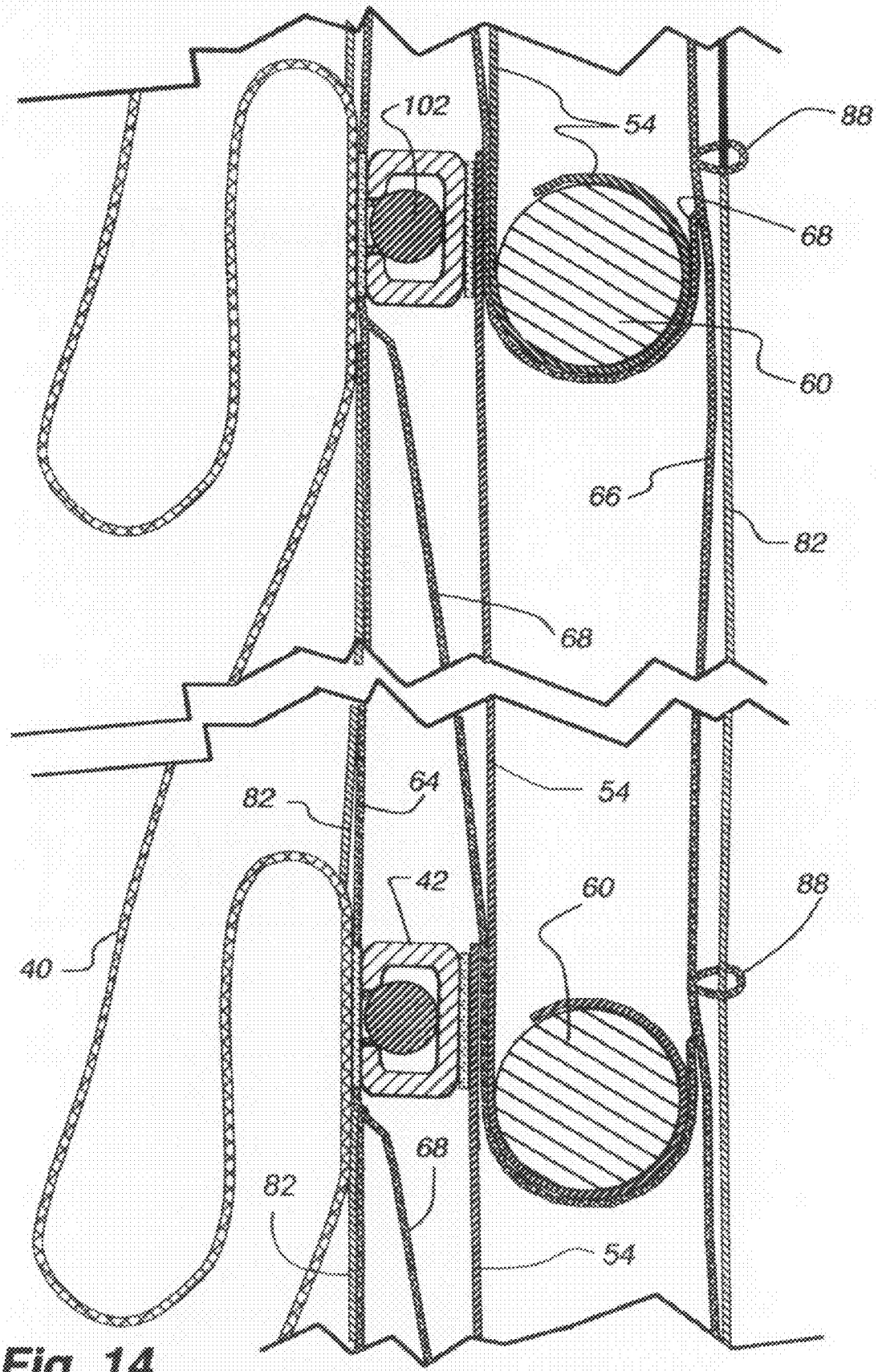
FIG. 14 is an enlarged fragmentary section taken along line 14-14 of FIG. 1.
Figure 15:
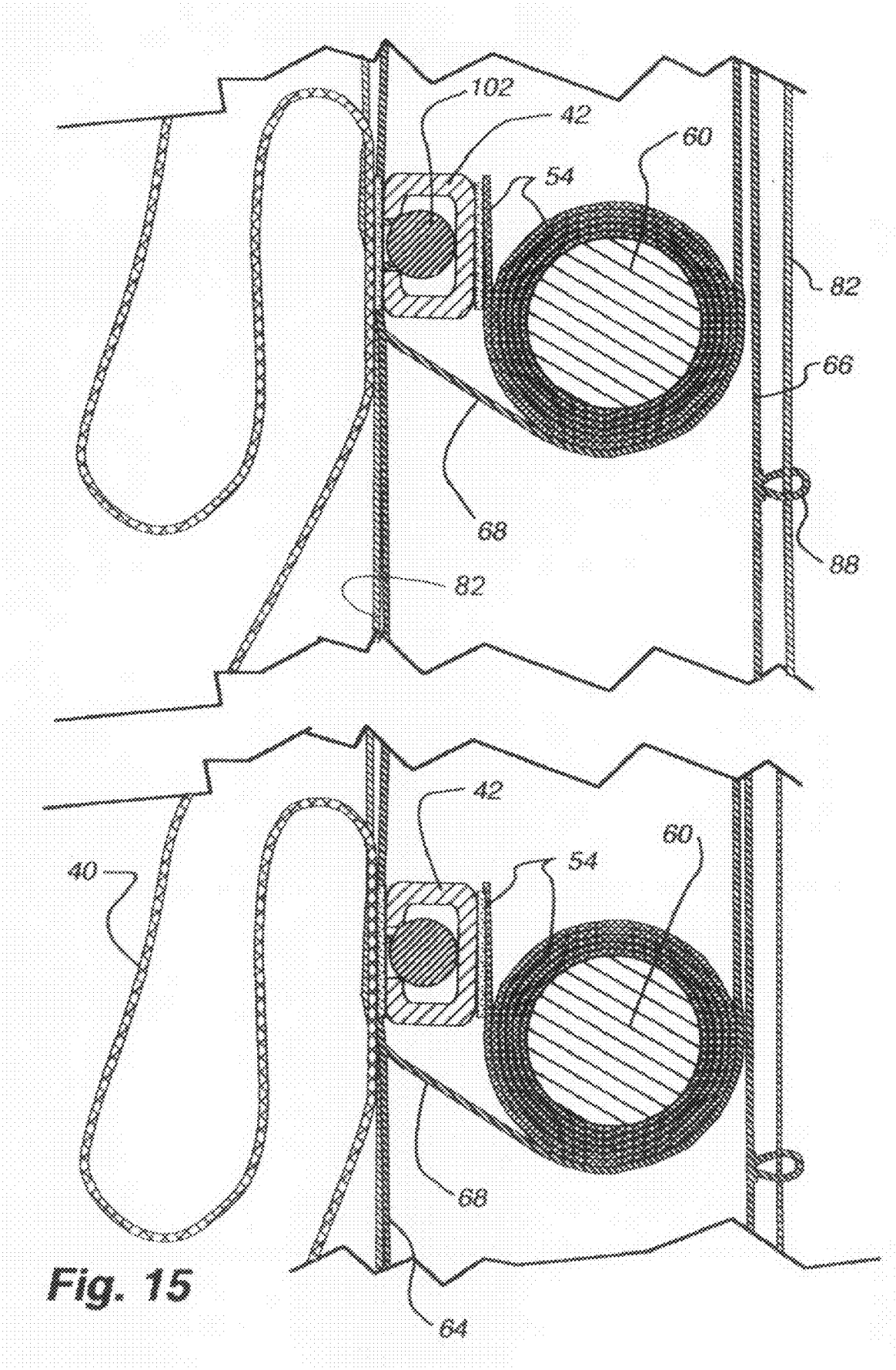
FIG. 15 is an enlarged fragmentary section taken along line 15-15 of FIG. 3.

Accordingly, FIG. 14 shows the segmented covering component 36 in a fully extended or closed position and FIG. 15 shows it in a fully retracted or open position. The take-up roller 70 is locked in the fully retracted position of FIG. 15 with a conventional cord lock system 78 in the headrail to be described hereafter, but by releasing the cord lock system, the weight of the rollers 60 in each roller assembly 38 under the influence of gravity pulls the rear run 66 of each cord ladder downwardly allowing the roller of each roller assembly to unroll the strip 54 therefrom and move from the position of FIG. 15 to the position of FIG. 14 with the lower edge of each strip 54 resting upon a corresponding rung of a ladder.

Figure 7:
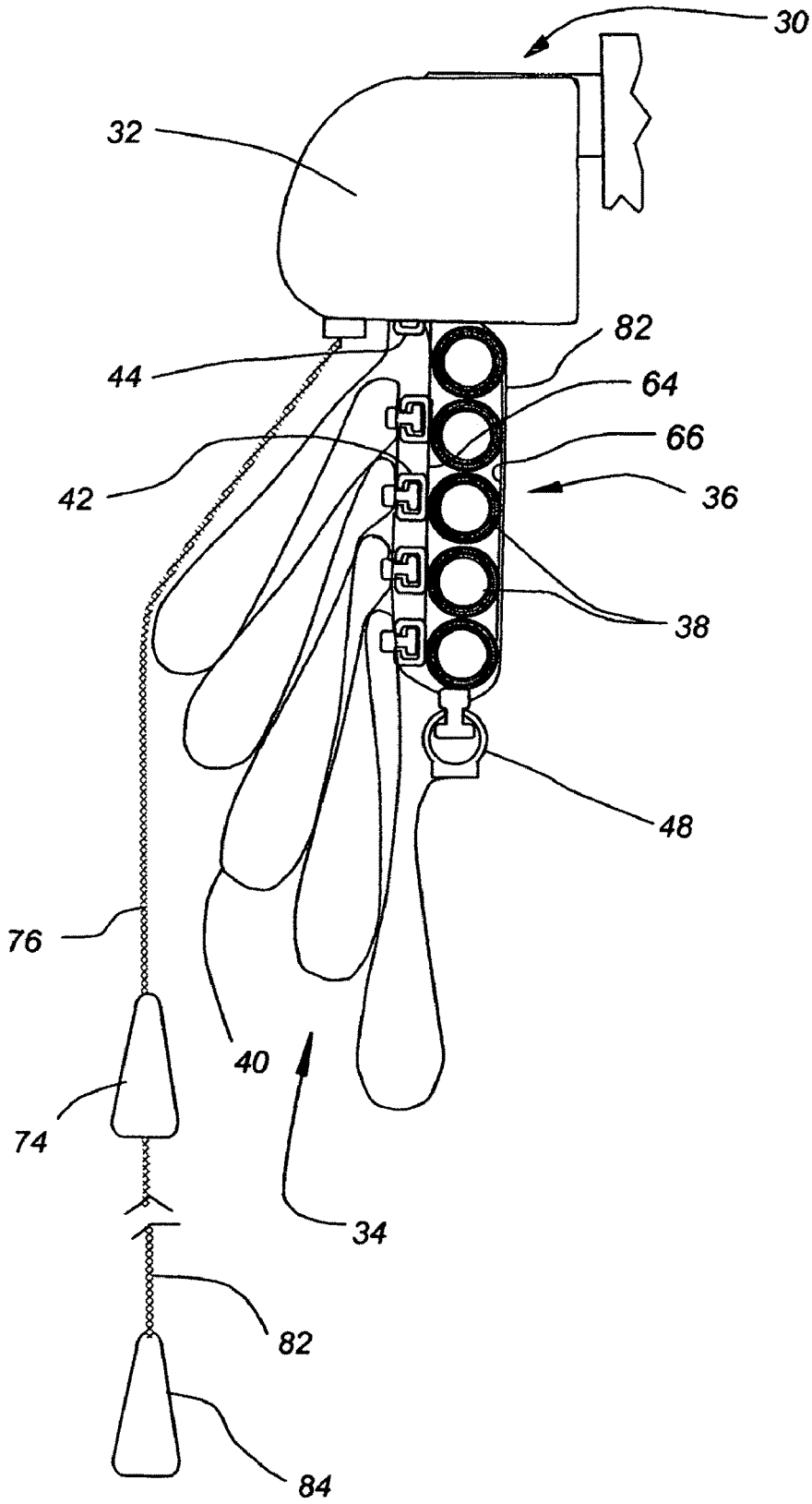
FIG. 7 is a side elevation showing the front and rear panels of the covering fully retracted.
Figure 8:
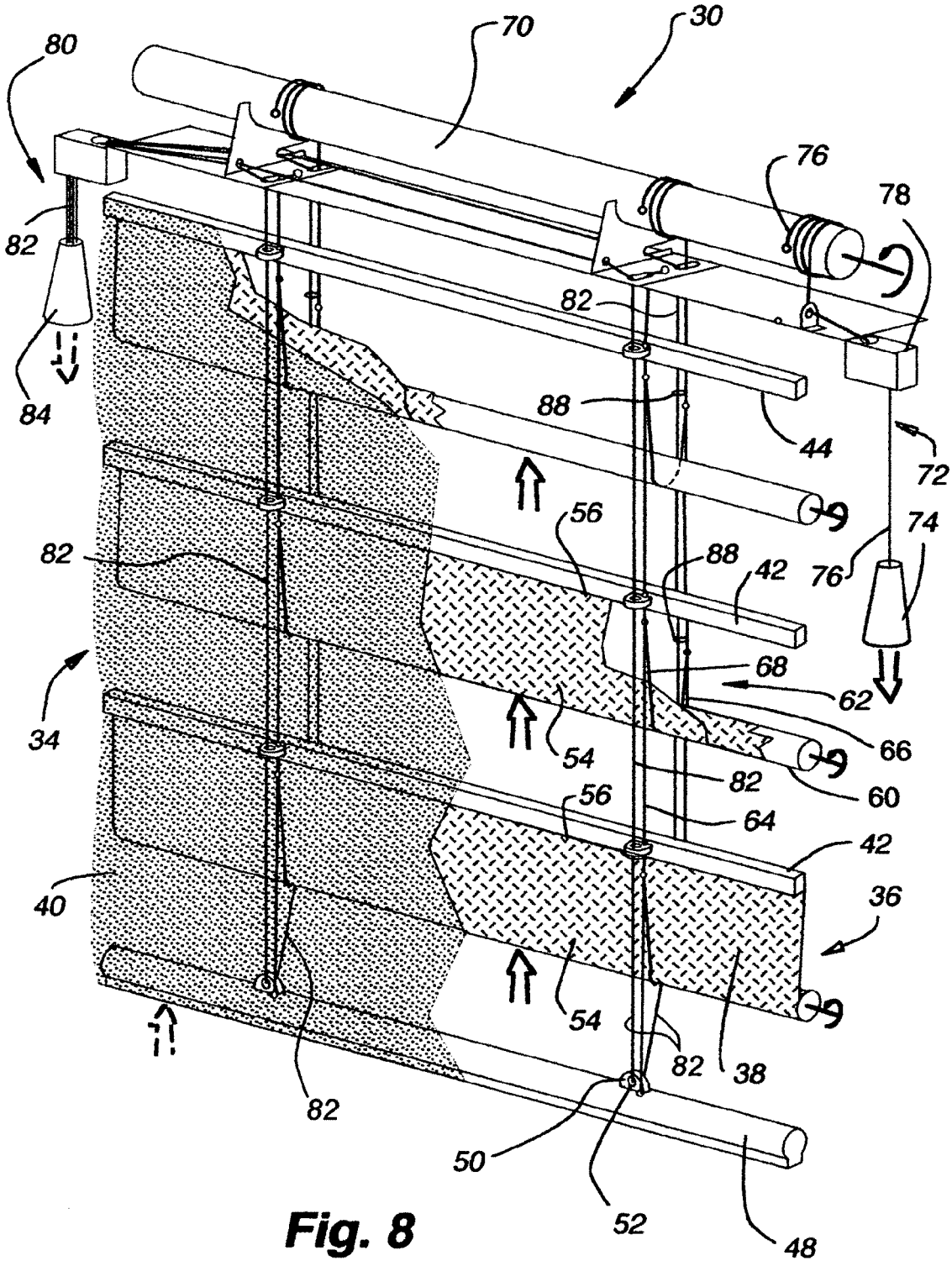
FIG. 8 is an isometric similar to FIG. 2 with parts removed for clarity.

A second control cord system 80 is utilized to raise the entire covering 30 from the fully extended position of FIGS. 1-3 to the fully retracted position of FIG. 7. The second control cord system utilizes a plurality of loops 82 (only two being shown for exemplary purposes) of flexible lift cord or the like with each end of each loop being anchored in a tassel 84, which can be manually operated, and wherein the lift cord loops pass through a conventional cord lock system 86 to be described hereafter. Each loop 82 of lift cord associated with the second control system extends downwardly adjacent the rear of the covering through a plurality of guide loops 88 formed or otherwise attached to the rear vertical run 66 of an associated cord ladder 62, through the hole 52 in an associated bracket 50 on the bottom rail 48, and then upwardly adjacent to the battens 42 with this portion of each cord loop being slidably secured to the battens as it passes thereby. Accordingly, each lift cord loop 82 extends around the various components of the covering 30 so that when the loops are shortened by pulling on the associated tassel 84, the bottom rail is lifted gathering each of the battens 42 and each of the roller assemblies 38 until they are stacked adjacent the head rail 32 as shown in FIG. 7. In this position, the cord loops in the second control system can be locked with the cord lock 86. Of course, to lower the covering from the position of FIG. 7 to the position of FIGS. 1, 2, or 3, the cord lock 86 is merely released allowing the entire covering to drop by gravity to any fully or partially extended position.

It is desirable before retracting the covering to the position of FIG. 7 that each roller assembly 38 be retracted into the position of FIG. 15 even though this is not mandatory. It should also be appreciated there could be any desired or necessary number of lift cord loops 82 or cord ladders 62 depending upon the width of the covering.

Referring to FIGS. 9A-9G, the components of the covering 30 of the present invention, as previously described, can be more fully appreciated. As mentioned previously, the front covering component 34, which in the presently described embodiment is a sheet 40 of sheer fabric, is secured to each batten 42 at the place 46 where the sheer fabric is reverse folded. To better understand the connection of the battens to the front component of the covering and the battens role in the operation of the segmented rear component 36 of the covering, it will be appreciated the battens are all of generally square tubular form having a forwardly opening horizontal slot 90 through its front wall 91. A clip 92 shown in FIG. 9G is adapted to be inserted into the slot 90 in horizontal alignment with an associated cord ladder 62 and an associated cord loop 82 of the first and second control cord systems.

The clip 92 has an enlarged block-like body 94 with a vertical rectangular passage 96 therethrough and a pair of rearwardly projecting somewhat resilient fingers 98 having catches 100 on their ends which can be inserted through the slot 90 in the batten and retained therein once the catches pass beyond the front wall 91 of the batten as best seen in FIGS. 9A, 9C, and 9F. The clip can be retained at a longitudinally or horizontally selected position in alignment with an associated cord loop 82 and cord ladder 62 by inserting positioners 102 into the hollow batten from either side of the clip as seen in FIG. 9E. As will also be appreciated with the description hereafter, the clip serves to not only anchor the sheer fabric 40 but also provide a guide for a looped control cord 82 which slidably passes through the vertical rectangular passage 96 and a means for anchoring the front run of each cord ladder to the batten so the front run 64 of each cord ladder does not slide or move relative to the battens but rather moves therewith. Each batten as mentioned previously also serves as an anchor for the top edge of each strip 54 of material associated with each roller 60 of a roller assembly 38.

With reference to FIGS. 9A, 9C, 9E and 9F, the sheer fabric 40 can be seen secured to the front face of the block-like body 94 of each clip 92 and this connection can be made preferably with adhesive, but could also be ultrasonically bonded, secured with a hook-and-loop type fastener, such as Velcro, or any other suitable means. There is, accordingly, a horizontal line of attachment of the sheer fabric with each clip used in the system. The horizontal line of attachment is not continuous, however, but is only connected to the battens 42 at the locations of the clips.

As also seen in FIGS. 9A, 9C and 9F, the top edge of the flexible strips 54 of material associated with a roller 60 in a roller assembly 38 is secured to the rear side of the batten 42 with adhesive, ultrasonic bonding, hook-and-loop type fastener, or the like. As mentioned previously, the vertical rectangular passage 96 through each clip is adapted to slidably receive the forward run of the looped control cord 82 associated with the second control system 80 so that when the looped control cord is shortened as by pulling its associated tassel 84, the looped cord will slide through each clip 92 while lifting the bottom rail 48 which in turn operatively engages the lowest batten 42 and collects all of the battens as it is raised toward the head rail 32.

With reference again to FIG. 9G, the somewhat resilient fingers 98 of a clip 92 have a notch 104 in the center thereof which is adapted to receive the front vertical run 64 of an associated cord ladder 62 so that as best appreciated in FIG. 9F, as the front vertical run of a cord ladder passes by the clip, it is crimped or pinched between the clip and the associated batten 42 so the front vertical run will not move relative to the batten.

With reference to FIGS. 10-13, the second control cord system 80 can be seen to be operated by the two endless loops 82 previously described, the ends of which are anchored in the tassel 84 which can be manually pulled down to raise the covering or allowed to elevate when the covering drops by gravity to the extended position of FIG. 1. For illustrative purposes, there have only been two looped control cords illustrated even though if the covering were of a greater width, additional loops of control cords might be desirable.

Figure 10:
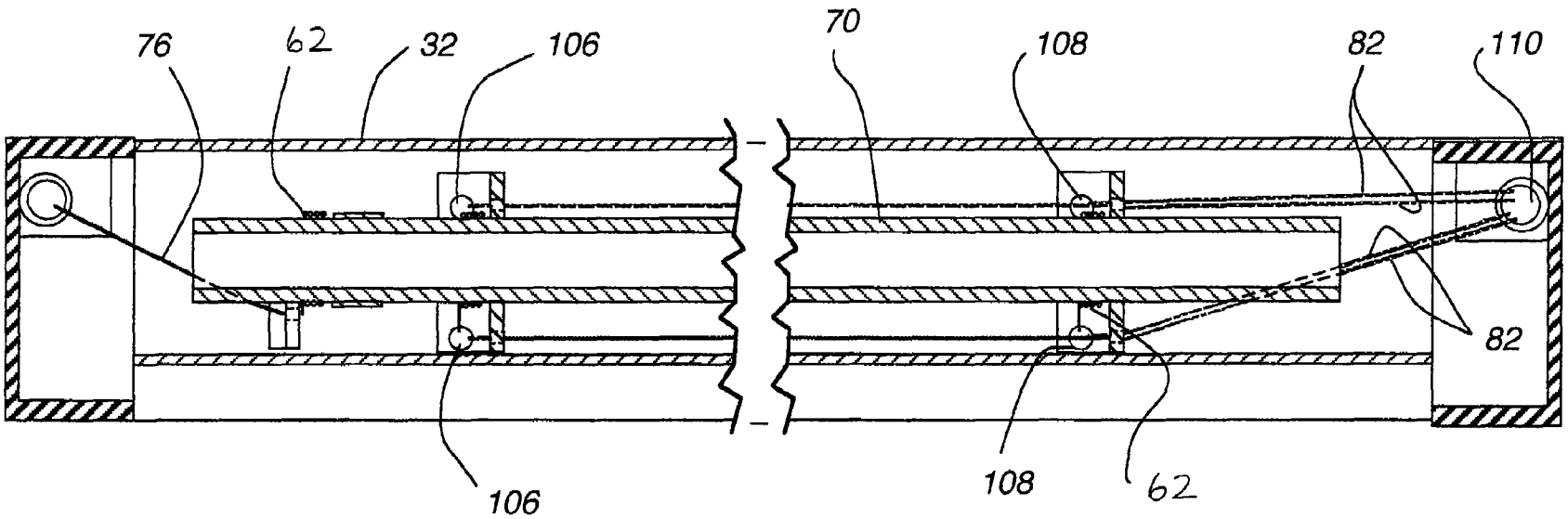
FIG. 10 is an enlarged fragmentary section taken along line 10-10 of FIG. 2.
Figure 11:
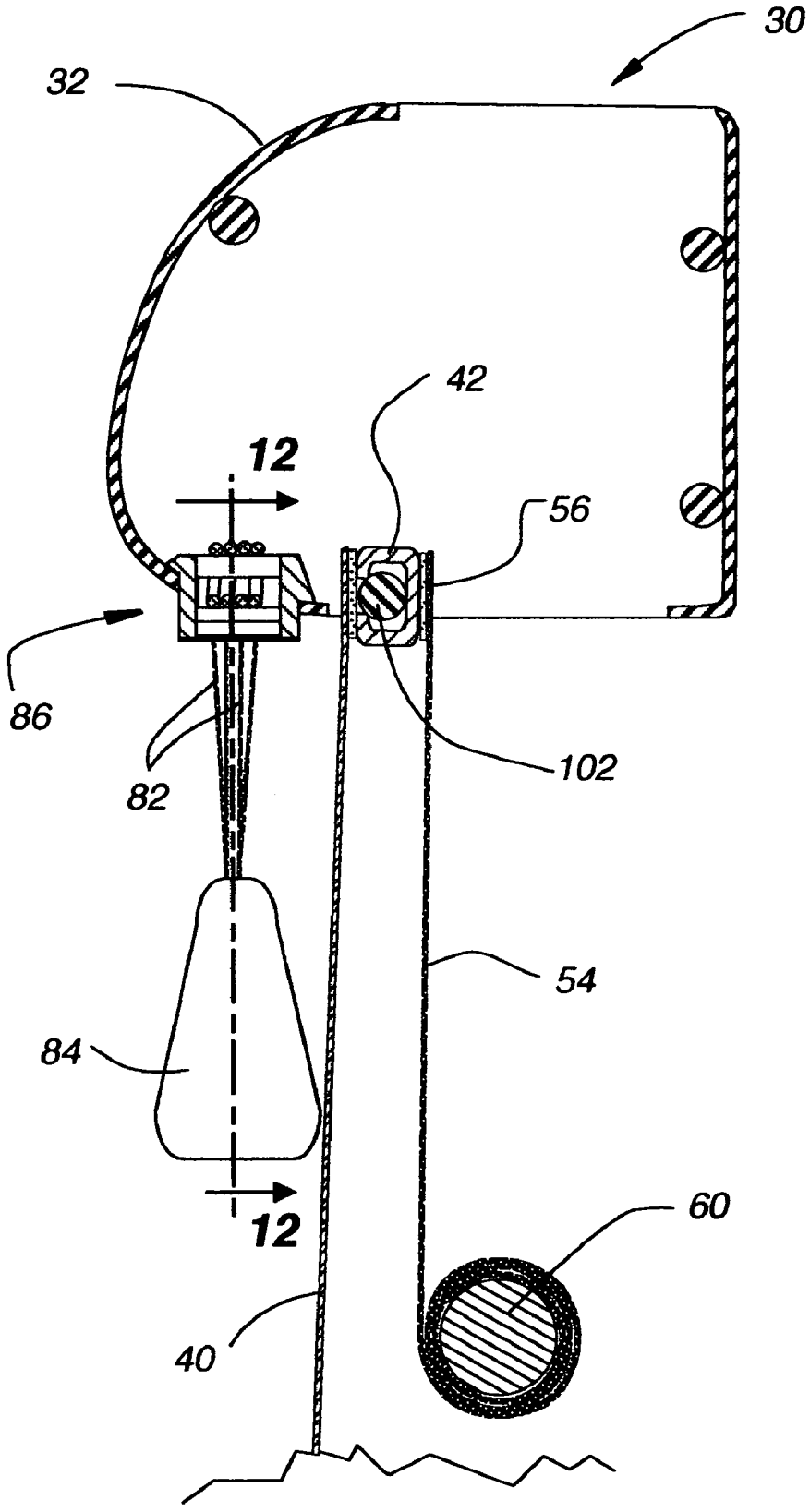
FIG. 11 is an enlarged section taken along line 11-11 of FIG. 2.

With reference first to FIG. 10, it will be appreciated there are two pairs of holes 106 and 108 through the bottom of the head rail 32 at longitudinally spaced locations with each pair of holes being in alignment with a looped cord 82 as well as an associated cord ladder 62. The cord ladder, of course, is not directly associated with operation of the second control system 80. In the second control system, the looped cord adjacent one end of the head rail extends upwardly through one pair 106 of the holes before extending longitudinally of the head rail and passing downwardly through a relatively large opening 110 at the opposite end of the head rail for connection to the tassel 84. The second pair of holes 108 have the second looped cord passing upwardly therethrough with the ends of that looped cord also passing longitudinally of the head rail and downwardly through the relatively large opening 110 for connection to the tassel 84. It will therefore be appreciated when the tassel is pulled downwardly, each of the cord loops is raised to lift the bottom rail 48 of the covering 30 thereby gathering the battens 42 and the roller assemblies 38 until at the fully retracted position, the battens and roller assemblies are accumulated adjacent to the head rail as shown in FIG. 7.

Figure 12:
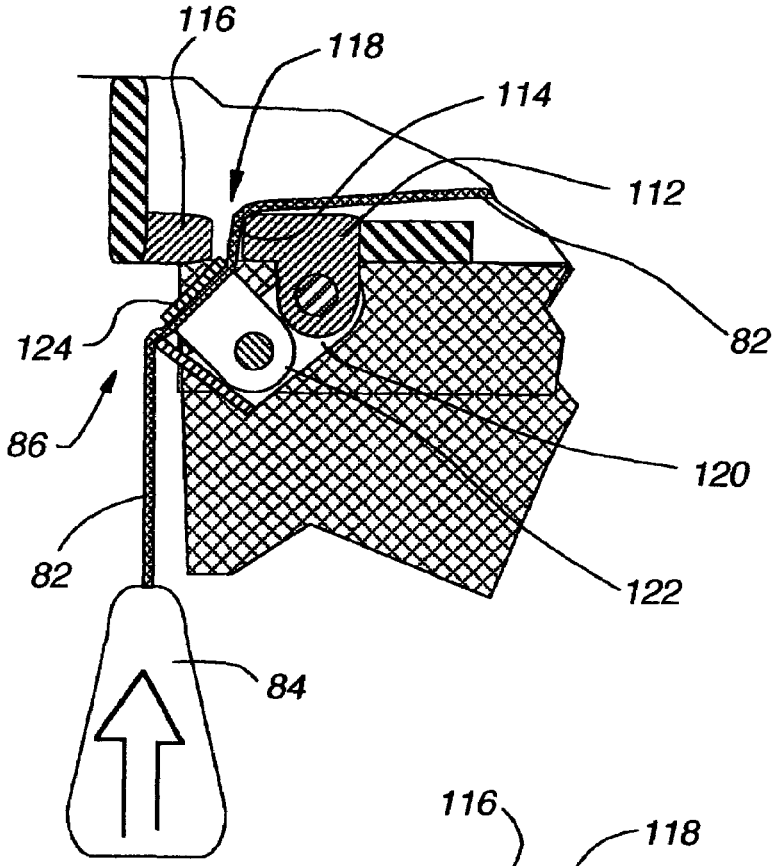
FIG. 12 is a fragmentary section taken along line 12-12 of FIG. 11 showing the cord lock in a locked position.
Figure 13:
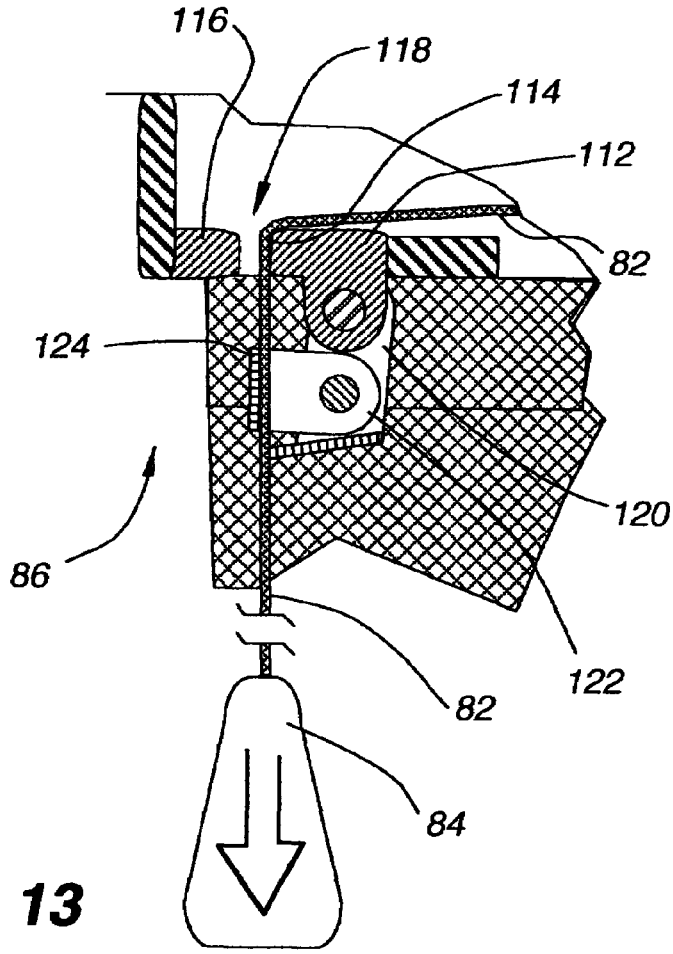
FIG. 13 is a section similar to FIG. 12 with the cord lock in an unlocked position.

The cord lock 86 for holding the looped cords 82 in any position is shown in FIGS. 12 and 13 with FIG. 12 showing a locked position of the cord lock and FIG. 13 an unlocked position. The cord lock can be seen to be a three-piece cord lock having an upper L-shaped element 112 with one edge 114 spaced from a bar 116 in the head rail to provide a vertical gap 118 therethrough, a link member 120 pivotally connected at its upper end to the first L-shaped member and a lock arm 122 pivotally connected to the opposite lower end of the link 120. The lock arm has a passage 124 therethrough adjacent its free end so that when the cord lock is in the unlocked position of FIG. 13, the cords 82 are free to slide vertically through the passage in the lock arm. However, by shifting the tassel 84 to the left as shown in FIG. 12, and allowing the cords to rise slightly, the lock arm 122 is pivoted in a clockwise direction approximately 45 degrees so the passage 124 through the lock arm forms an angle with vertical and thereby pinches the cord loops whereby they are not free to pass through the cord lock. The cords can be placed in the locked position at any elevation of the covering so it can be fully retracted, fully extended, or releasably positioned at any position therebetween.

The operation of the second control system 80 is seen best in FIGS. 10, 14, 15, and 16A-16D. As mentioned previously, FIG. 14 illustrates the segmented covering component 36 of the covering in its fully extended position with each flexible strip 54 of material used in the rear segmented covering component being substantially fully unwrapped from its associated roller 60 and from the next adjacent upper batten 42. As also mentioned previously, the roller 60 associated with each flexible strip of material is cradled on a rung 68 of a cord ladder 62 with the rung being substantially vertically oriented with its forwardmost end that is connected to the front vertical run 64 of the cord ladder being substantially above the connection of the rung to the rear vertical run 66. The rear vertical run of the cord ladder is in a lowered position, i.e., in its lowermost position of FIG. 14. It is movable only between the extreme lower and upper positions of FIGS. 14 and 15.

The take-up roller 70, as seen in FIGS. 8 and 10, is horizontally and rotatably mounted in the head rail 32. The rear vertical run 66 of each cord ladder 62 has its upper end secured to the take-up roller so that as the take-up roller is rotated in a counterclockwise direction as viewed in FIG. 8, the rear vertical run of each cord ladder is wrapped around the take-up roller and elevated relative to the front vertical runs 64 of the cord ladders, which are held in a fixed relationship with the battens 42. Counterclockwise rotation of the take-up roller is effected with the drive cord 76 whose upper end is anchored to the take-up roller and the lower end to the tassel 74 so that as the tassel is pulled downwardly, the take-up roller is rotated in a counterclockwise direction raising the rear vertical runs of the cord ladders.

The drive cord 76 associated with the tassel 74 passes through the cord lock 78 which is identical to the previously described cord lock 86 so the lift cord can be locked at any location and thus the rear vertical run of the cord ladder can be locked in any position.

Figure 16A:
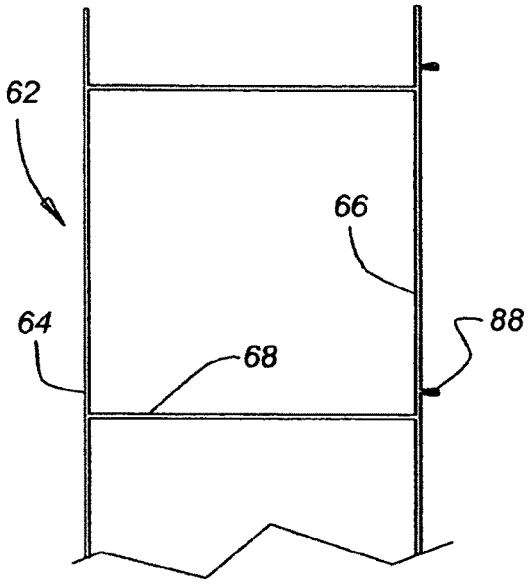
FIG. 16A is a horizontal section taken through the cord ladder used to support the roller assemblies with the cord ladder in an elevated position.
Figure 16B:
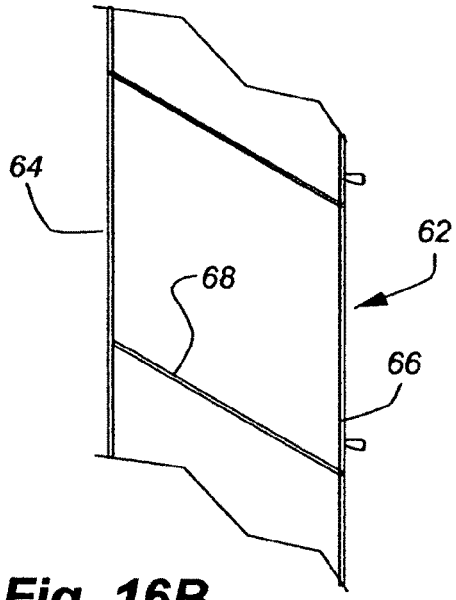
FIG. 16B is a fragmentary section similar to FIG. 16A with the cord ladder in a partially lowered position.
Figure 16C:
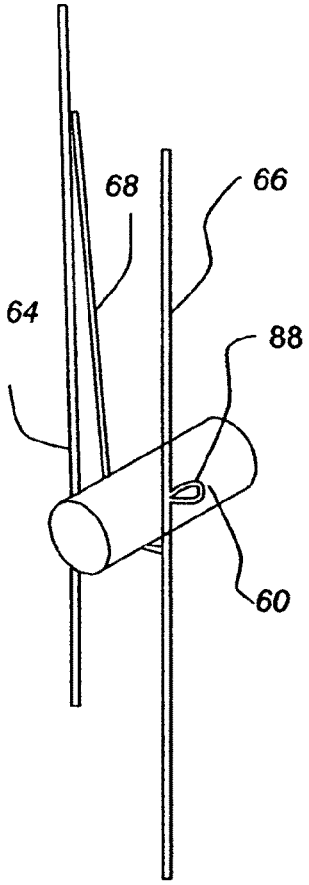
FIG. 16C is an isometric illustrating a roller of a roller assembly positioned in the cradle of the cord ladder in a lowered position.
Figure 16D:
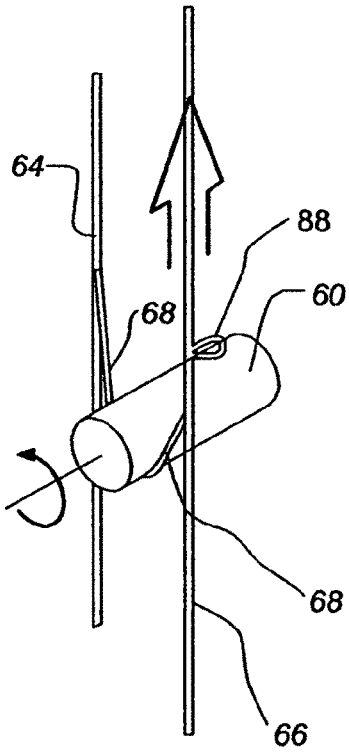
FIG. 16D is an isometric showing the roller of the roller assembly in a partially raised position of the cord ladder.
Figure 16E:
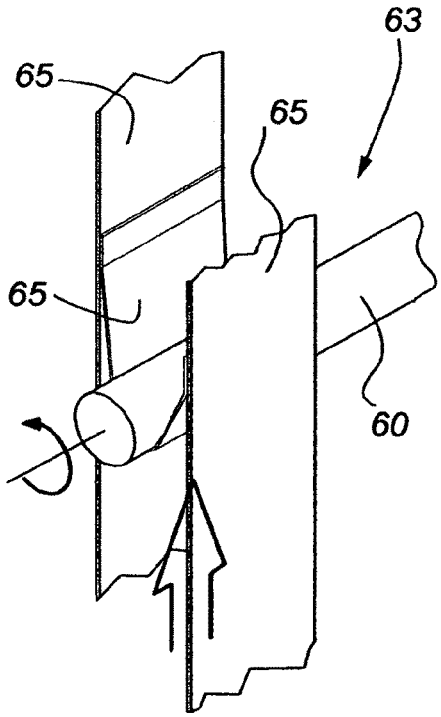
FIG. 16E is an isometric similar to FIG. 16D illustrating a roller of a roller assembly positioned in the cradle of a tape ladder as an alternative.

FIGS. 16A-16D are diagrammatic representations illustrating what happens with a roller 60 of a roller assembly 38 when the rear vertical run 66 of a cord ladder 62 is raised. FIG. 16A shows a cord ladder when the rear vertical run is fully raised, and 16B shows the cord ladder when it is fully lowered. FIG. 16D shows the roller 60 of a roller assembly 38 positioned on a cross rung 68 and thereby cradled at the lowermost position of the rear vertical run, and FIG. 16D shows the rear vertical run being elevated which thereby lifts the rear extent of the cross rung lifting the roller while rolling the roller in a counterclockwise direction. As will be appreciated by reference to FIGS. 14 and 15, as the roller is rotated in a counterclockwise direction, the flexible strip 54 associated therewith is wrapped around the roller. As also mentioned previously, while the friction of the roller with its associated cord ladder rungs is enough to roll the roller and the flexible strip thereon so the flexible strip is wrapped around the roller, it is sometimes beneficial to preform a coil into the flexible strip so it rolls more easily. The flexible strip even when precoiled will unroll from the roller due to the weight of the roller dropping when the rear vertical run of the cord ladder is lowered.

Figure 17:
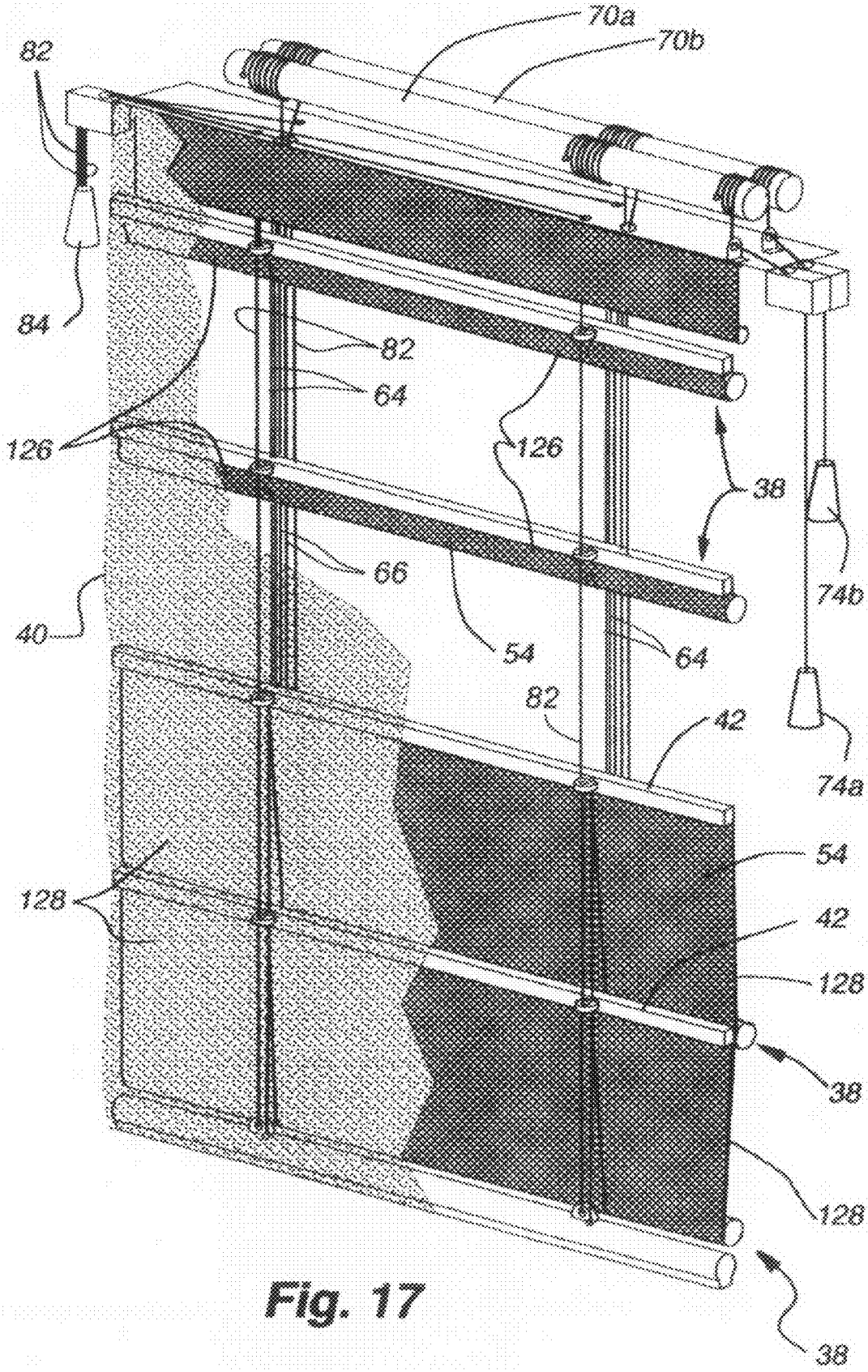
FIG. 17 is a diagrammatic isometric of a first alternative embodiment with parts removed for clarity.

There are many variations to a covering of the type previously described herein with one of those variations or embodiments being shown in FIG. 17. In this embodiment, there are upper 126 and lower 128 sets of roller assemblies 38. In the disclosed embodiment, there are two upper roller assemblies in the upper set 126 and two lower roller assemblies in the lower roller set 128 with the upper roller assemblies working in unison and the lower roller assemblies working in unison, but possibly differently from each other. There is a separate but identical take-up roller 70*a* associated with the upper pair of roller assemblies and tassel 74*a* from a take-up roller 70*b* associated with the lower set of roller assemblies and a tassel 74*b* so the upper roller assemblies can be raised as illustrated while leaving the lower roller assemblies fully extended. Similarly, both the upper pair of roller assemblies and the lower pair of roller assemblies can be fully retracted or fully extended at the same time, or the upper pair of roller assemblies can be fully extended while the lower pair of roller assemblies are fully retracted. As with the first described embodiment, the roller assemblies can be partially extended or retracted as desired as well.

Figure 18C:
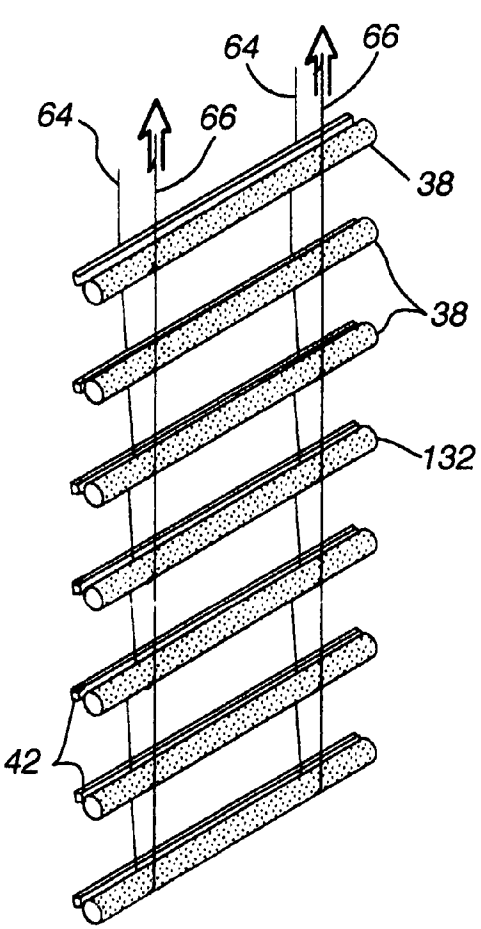
FIG. 18C is a diagrammatic isometric of the embodiment shown in FIGS. 18A and 18B with the covering in a fully retracted position.
Figure 18B:
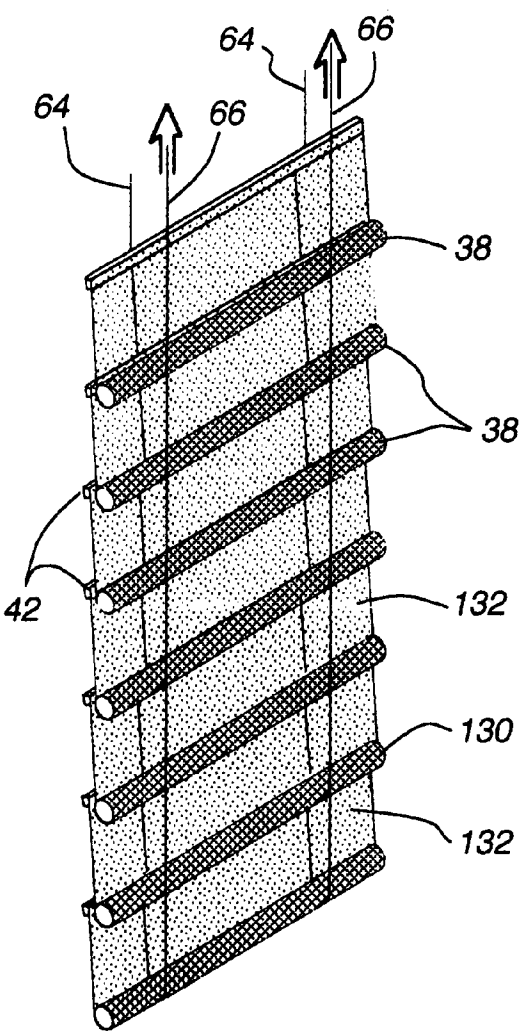
FIG. 18B is a diagrammatic isometric similar to FIG. 18A with the covering in a partially extended position.
Figure 18A:
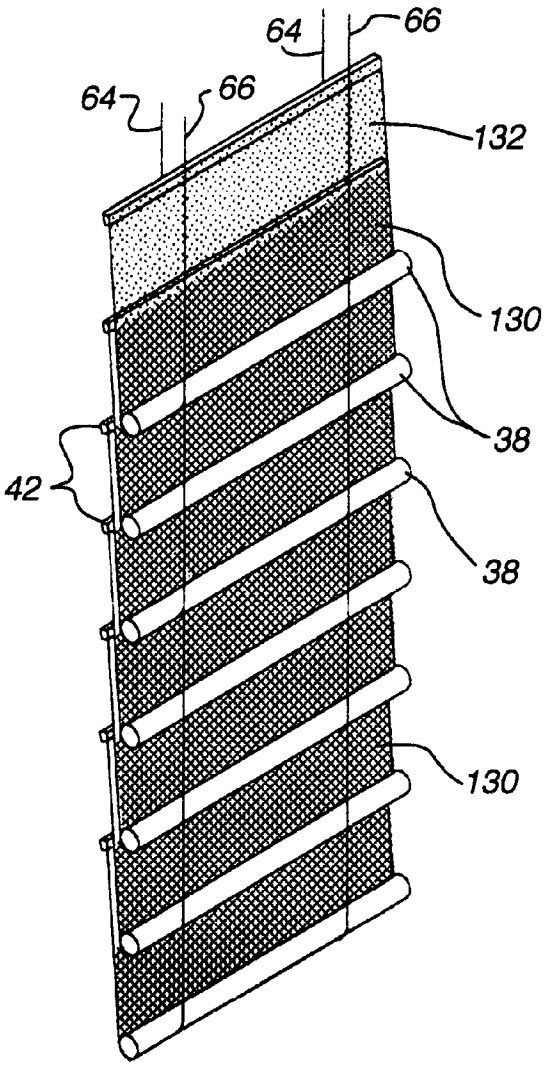
FIG. 18A is a diagrammatic isometric of a second alternative embodiment with the covering in a black-out position.

Another embodiment of the covering of the present invention is shown in FIGS. 18A-18C. In this embodiment, the front covering component of the first-described embodiment, i.e. the sheer fabric 40, has been removed so there are only horizontally vertically spaced battens 42 again connected to the front run 64 of a pair of cord ladders and again the rear run 66 of the cord ladders are associated with a take-up roller in the head rail (not shown) so the rear runs can be raised or lowered to allow the roller assemblies 38 cradled in the cord ladders to retract or extend, respectively. Further, as can be appreciated from FIGS. 18A-18C, the flexible strip of material 54 associated with each roller 60 can have two component parts 130 and 132 with the lower component part 130 being an opaque or black-out material, and the upper part 132 a translucent or transparent material of any desired fabric or color. With such an arrangement, when the strips of material 54 are fully extended, as shown in FIG. 18A, the black-out material 130 of each strip overlies the translucent material 132 of the next lower strip so the entire covering has a black-out affect or function. If the strips of material are only half unrolled from their associated rollers, as shown in 18B, the upper part 132 of the material is visible, but the black-out material 130 is wrapped around the roller and is therefore not visible. Of course, as shown in FIG. 18C, when the strips of material are fully retracted around their associated rollers, there is gap between the rollers through which vision and light can pass with no obstruction.

Figure 19:
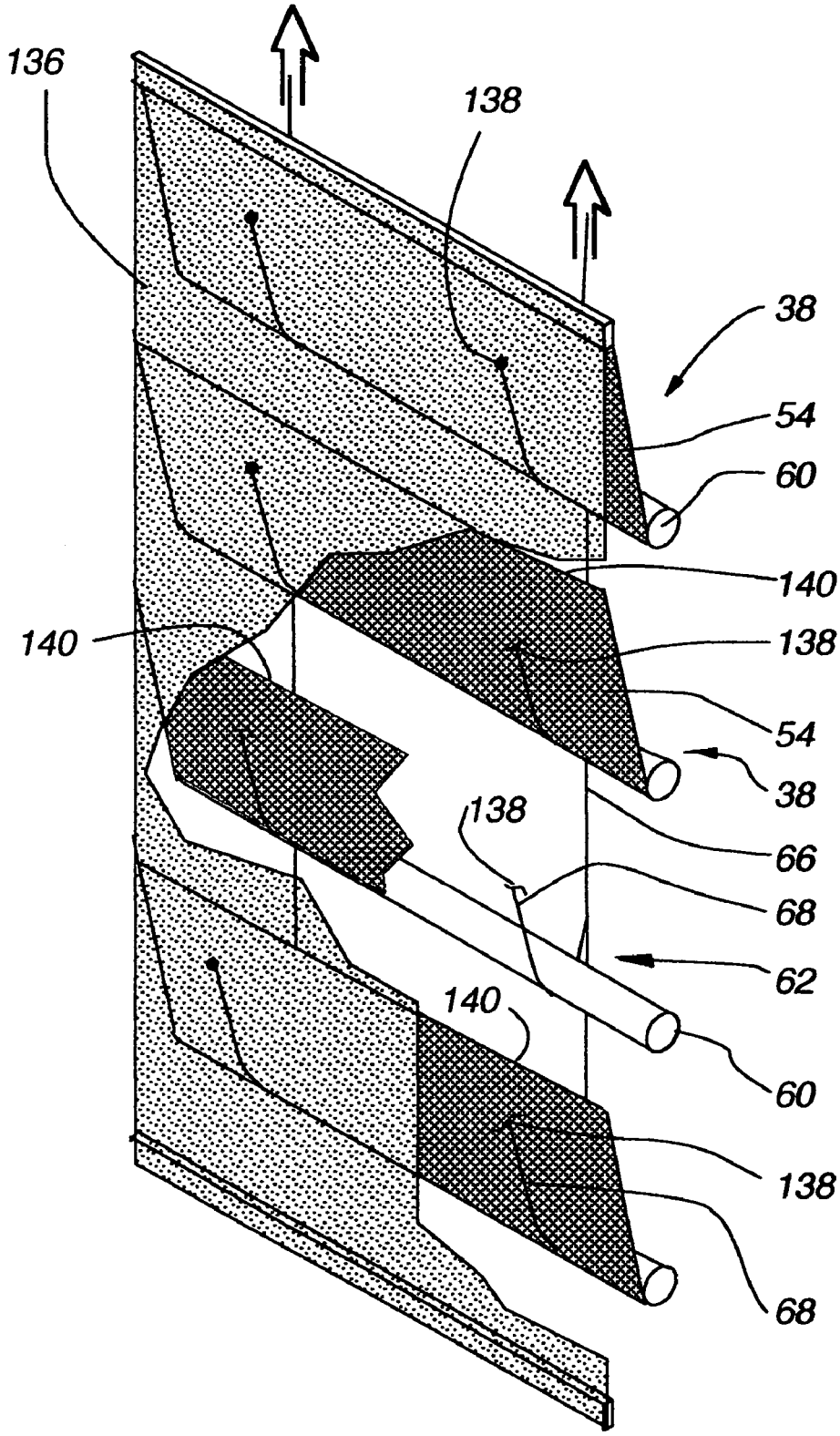
FIG. 19 is a diagrammatic isometric of a third alternative embodiment with parts removed for clarity.

FIG. 19 illustrates another embodiment of the invention where the sheer material 40 forming the front component of the first-described embodiment of the invention has again been removed and in addition the front vertical runs 64 of each cord ladder and the battens 42 are removed and replaced with a full sheet 136 of sheer material or other desired translucent or transparent material. The rear vertical runs 66 of each cord ladder 62 are again connected to a take-up roller 70 in the head rail 32 so they can be raised or lowered as desired to extend or retract the strips of material 54 associated with each roller 60 of a roller assembly 38. The cross rungs 68 of each cord ladder, however, have their free end 138 glued or otherwise tied and attached to the sheet 136 as though they were attached to the front run of a cord ladder as in the first-described embodiment. The top edge 140 of each flexible strip of material 54 forming part of a roller assembly 38 is affixed with adhesive, ultrasonic bonding, hook-and-loop type fasteners or the like to the sheet 136 of sheer material so the battens 42 are not necessary in this embodiment.

Figure 20:
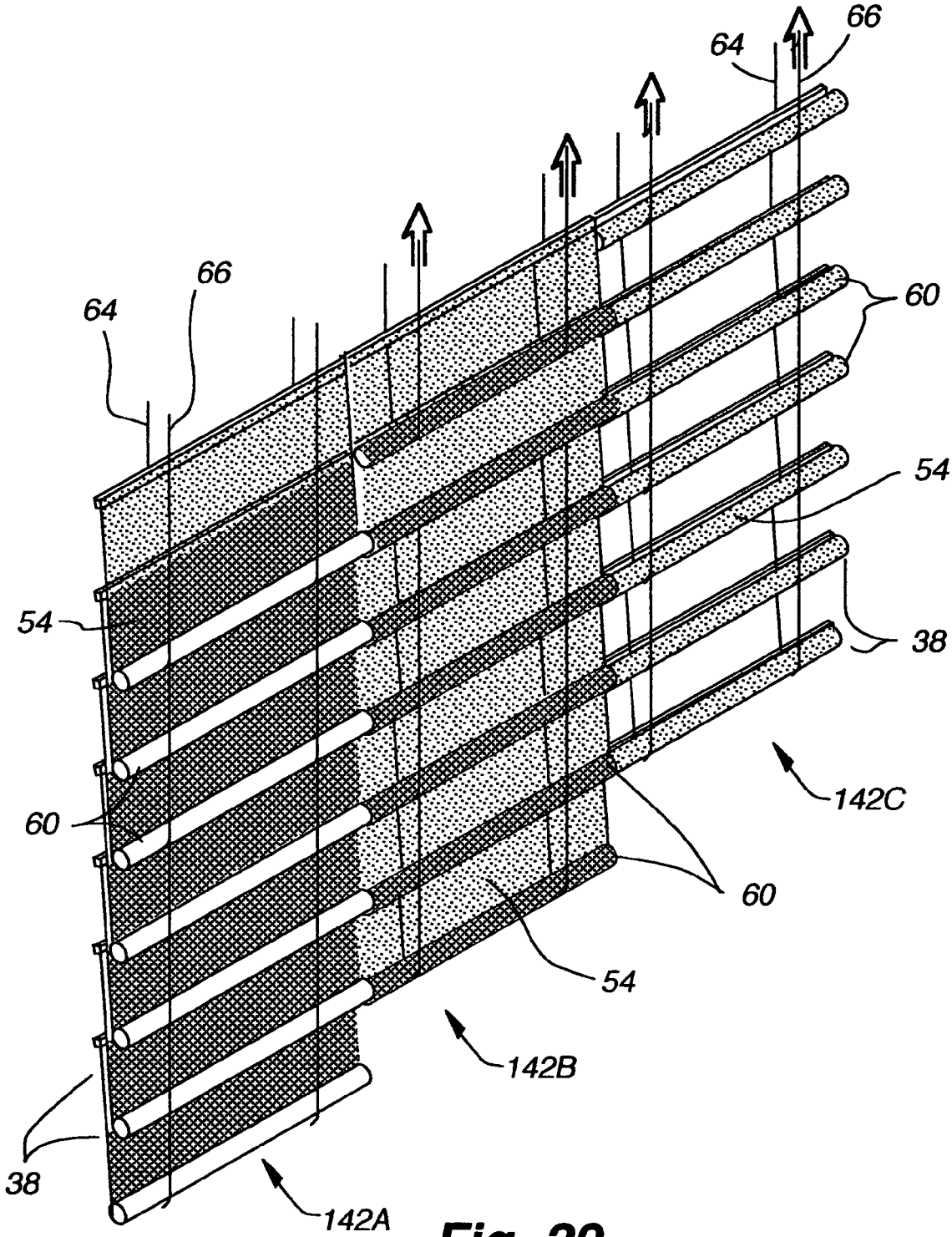
FIG. 20 is a diagrammatic isometric of a fourth alternative embodiment.

FIG. 20 illustrates another embodiment similar to that of FIGS. 18A-18C except the roller 60 of each roller assembly 38 has been made shorter so a plurality of identical covering sections 142A, 142B and 142C are placed in side-by-side relationship. There are distinct sets of cord ladders 62 associated with each covering section so each section can be extended or retracted independently of the other sections. With an arrangement of this type, the flexible strips 54 of material associated with each section can be different or each section can simply be raised or lowered differently than the others to provide a different aesthetic or to accommodate an architectural opening of unusual configuration. In the embodiment shown in FIG. 20, the section 142A to the left illustrates black-out material in a strip 54 of the type shown in FIGS. 18A-18C being exposed to totally black out that section of the covering while the section 142B in the middle has only been partially extended so the black-out material is wrapped around its associated roller, and the section 142C on the far right is fully retracted so there are gaps between the rollers.

Figure 23:
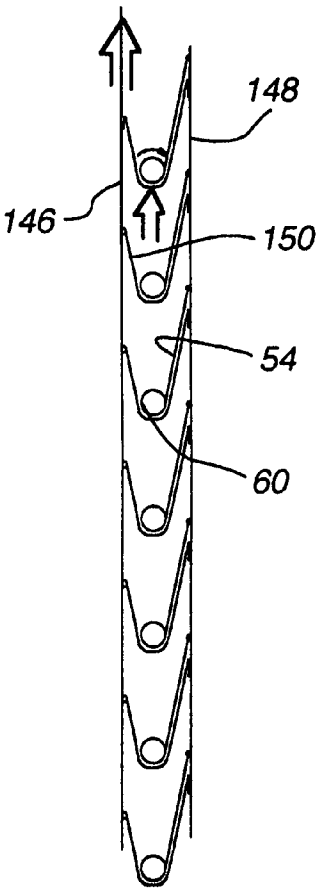
FIG. 23 is a side elevation of the panel of FIG. 21 supported by the support structure of FIG. 22.
Figure 22:
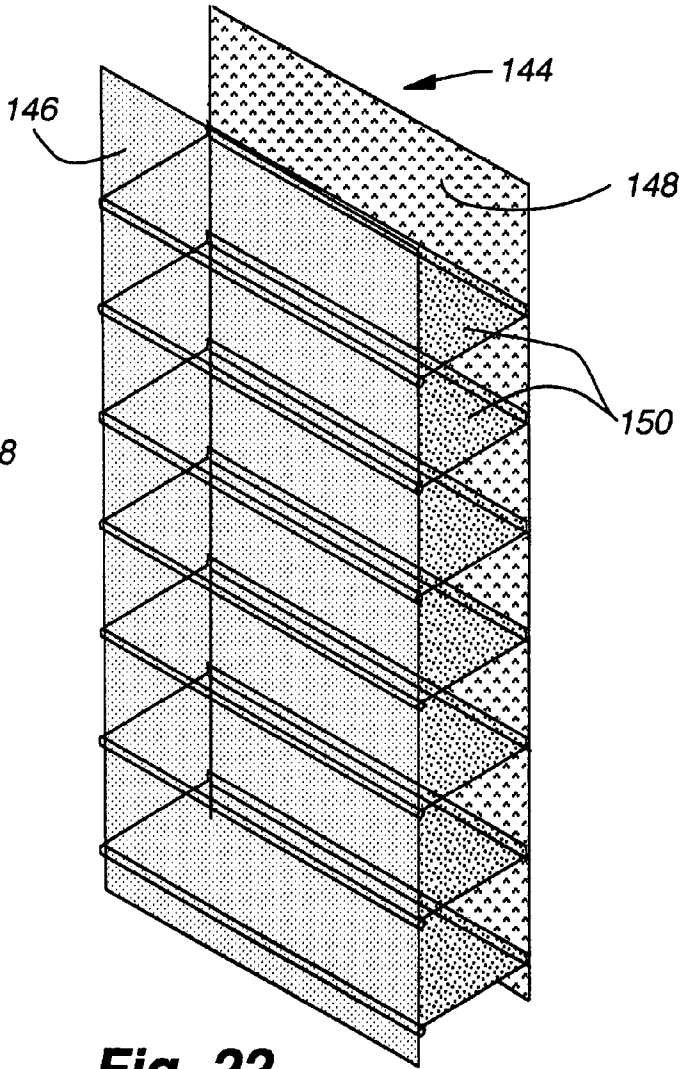
FIG. 22 is a diagrammatic isometric of a support structure for the panel of FIG. 21.
Figure 21:
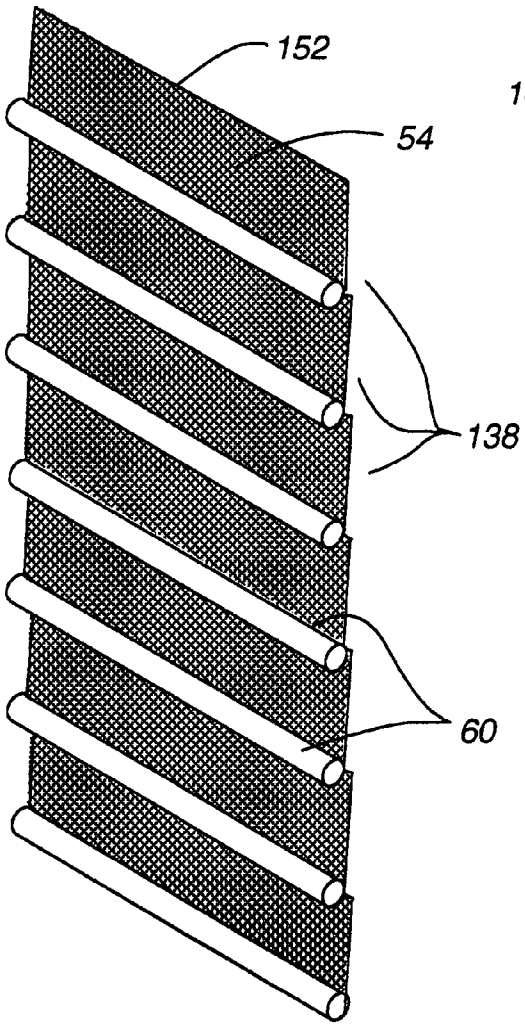
FIG. 21 is a diagrammatic isometric of a panel for use in a fifth alternative embodiment.

FIGS. 21-23 illustrate still another embodiment of the invention with FIG. 22 illustrating a replacement structure 144 for the cord ladders 62 used in the first-described embodiment. In the replacement structure, there is a front panel 146 replacing the front run 64 of a cord ladder, a rear panel 148 replacing the rear vertical run 66 of a cord ladder, and a plurality of transverse flexible vanes 150 replacing the cross rungs 68 of the first-described embodiment. The front and rear panels, as well as the vanes, can be made of any desired material be it translucent, transparent, or opaque. The roller assemblies 38 shown in FIG. 21 are identical to those in the first-described embodiment and are positioned individually on the vanes. The top edge 152 of each flexible strip of material 54 associated with a roller 60 in a roller assembly is secured to the rear panel 148 of material and the front panel 146 is lifted or lowered to cause the rollers to wrap or unwrap the associated flexible strip of material therefrom as shown in FIG. 23. Of course the front panel of material is raised and lowered with a take-up roller similarly to the rear vertical runs of the cord ladders of the first-described embodiment, and the rear panel remains extended or fixed even though a second control system (not shown) could be employed to lift the entire structure with the associated roller assemblies as in the first-described embodiment.

Figure 25:
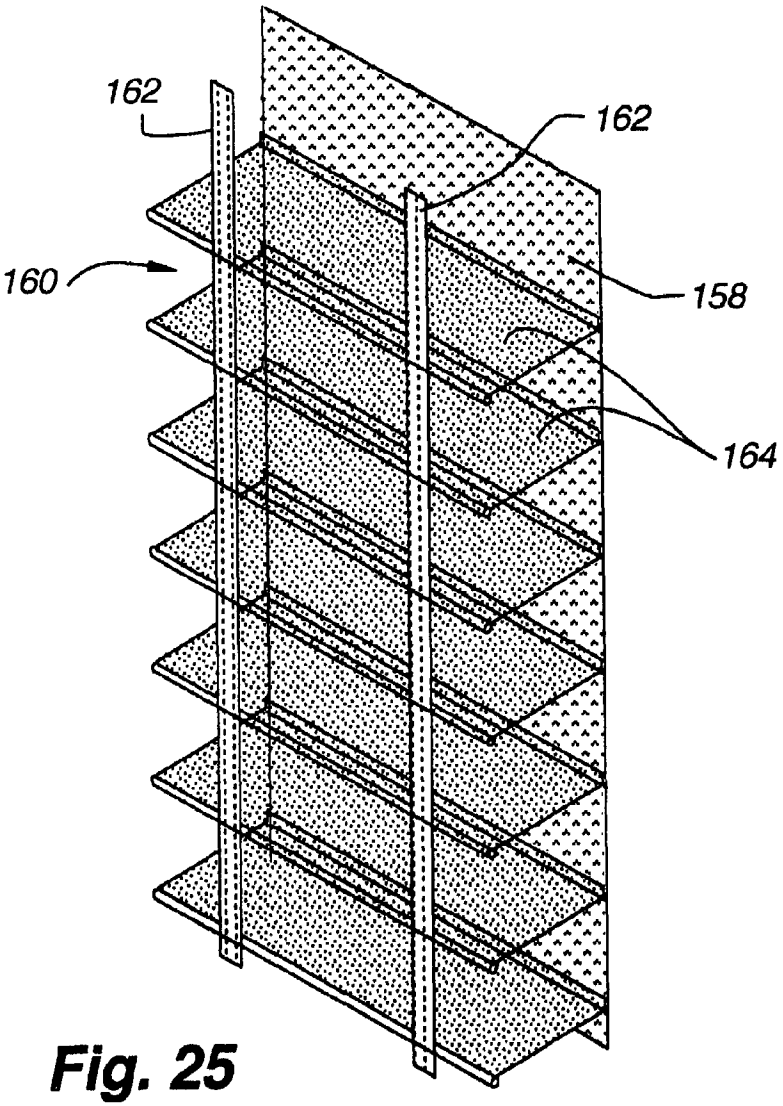
FIG. 25 is a diagrammatic isometric of another alternative support structure to that shown in FIG. 22.
Figure 24:
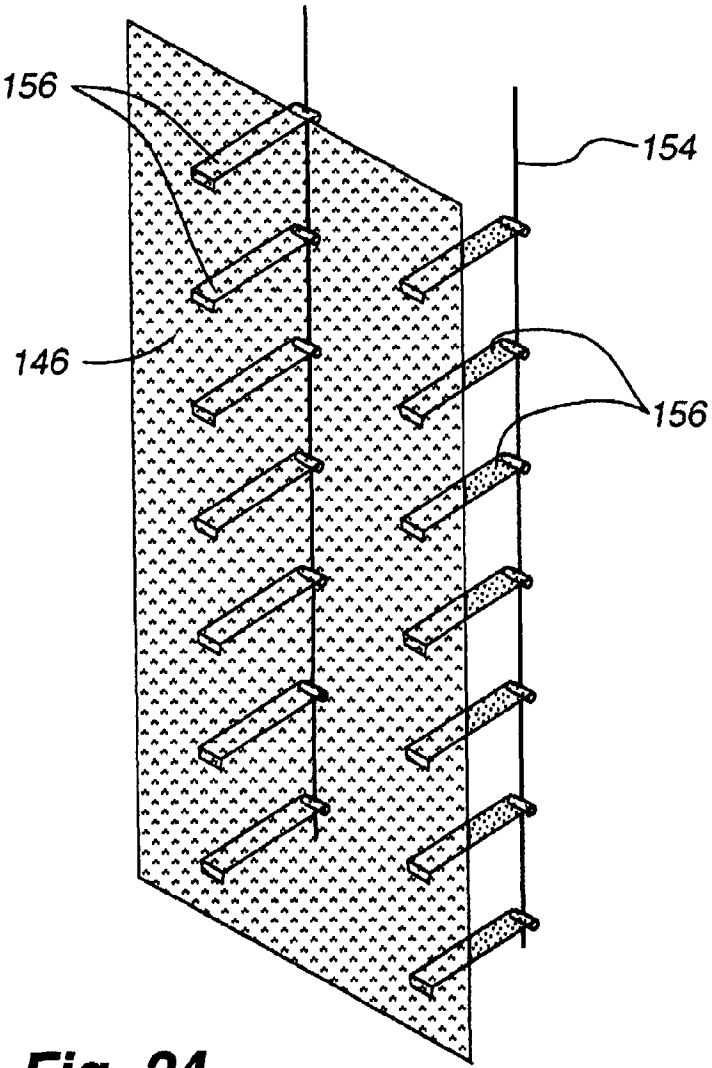
FIG. 24 is a diagrammatic isometric of an alternative support structure to that shown in FIG. 22.

Variations to the embodiment of FIGS. 21-23 are shown in FIGS. 24 and 25. In FIG. 24, the fixed rear panel 148 of material is replaced with a plurality of cords 154, microfibers, or the like, and the flexible fabric vanes 150 instead of extending the full width of the covering are relatively narrow strips 156 of flexible material at spaced intervals along the width of the covering. The front panel 146 is again a flexible sheet of material and the roller assemblies (not shown) would be cradled on the flexible strips 156 interconnecting the rear cords 154 with the front panel 146 of material. The covering of course operates identically to that described in the previous embodiments.

In FIG. 25, a rear sheet 158 of material is as used in the embodiments of FIGS. 21-23 but a front sheet 160 is a plurality of vertically extending horizontally spaced strips 162 of a flexible material such as sheer fabric. The rear sheet and the front strips of flexible material are interconnected with flexible strips or vanes 164 which extend the full width of the covering and serve to cradle roller assemblies (not shown) so the covering again operates in the same manner as the previously described embodiments.

Figures 26, 27:
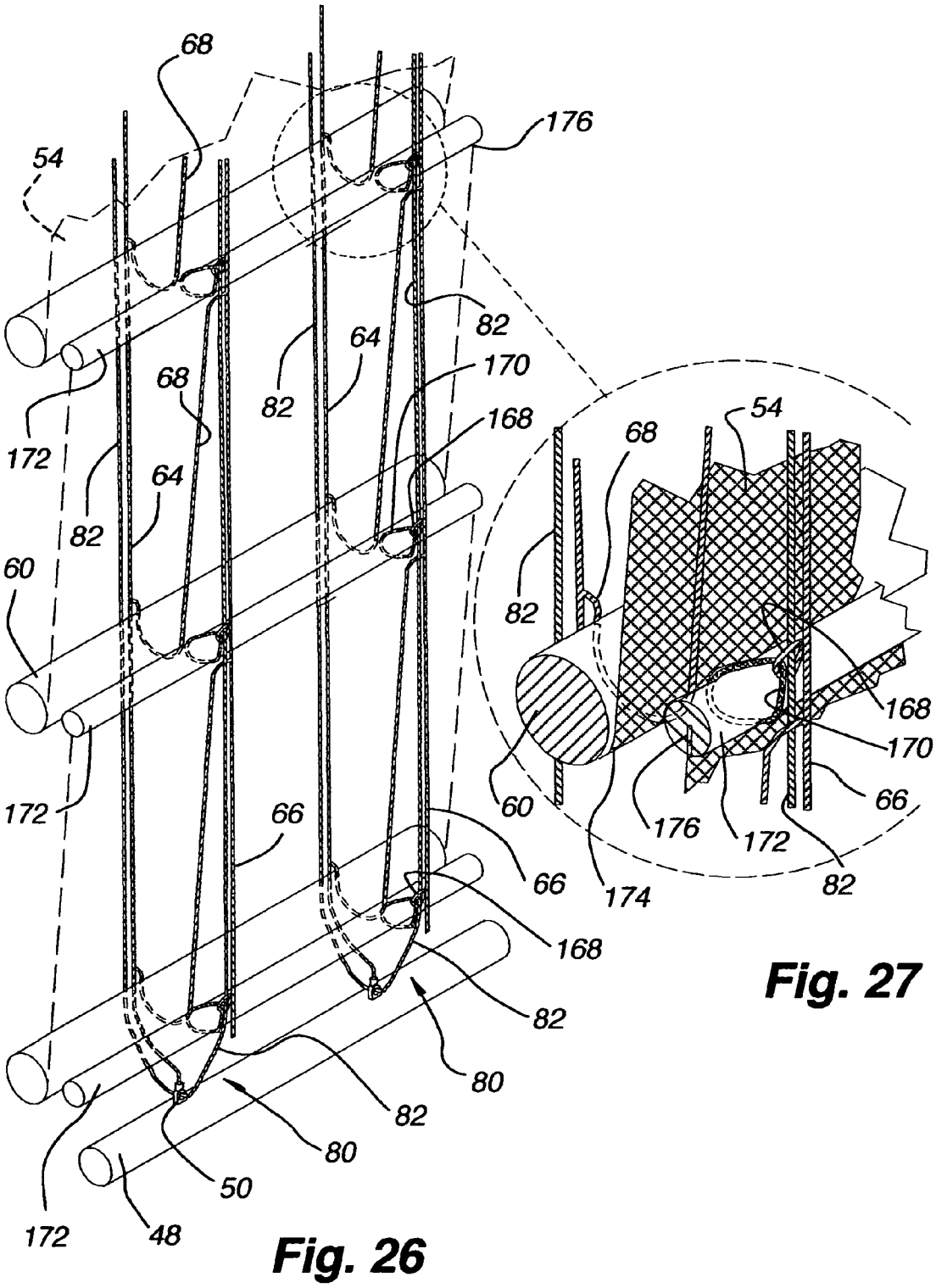
FIG. 26 is a diagrammatic isometric of a sixth embodiment of the present invention.
FIG. 27 is an enlarged fragmentary isometric of a portion of the embodiment shown in FIG. 26.

A still further embodiment of the covering of the present invention is shown in FIGS. 26 and 27. In this embodiment, the front covering component of the first-described embodiment has been removed even though the second control lift system 80 is still utilized whereby two endless loops 82 slidably pass through brackets 50 on a bottom rail 48 and are gathered near the head rail (not shown) by a tassel (not shown) that is operated identically to that of the first-described embodiment so the entire covering can be retracted by lifting the bottom rail and gathering the components thereabove in a stacked relationship adjacent to the head rail. The covering is extended by allowing the bottom rail to drop by gravity so all the components thereabove are also extended by gravity.

FIG. 26 is an isometric looking at the rear side of the covering and as will be appreciated, the rear vertical run 66 of a cord ladder 62 has small loops 168 formed thereon at vertically spaced intervals with the small loops acting as a guide for the cord loops 82 of the second control system 80. Also attached to the small loops are larger secondary loops 170 which support rod-like battens 172 so there are a plurality of vertically spaced horizontally extending battens suspended from the rear vertical run of the cord ladders. A plurality of cross rungs 68 extend from the rear vertical run of the cord ladders to the front vertical run 64 of the cord ladders 62 and define a cradle in which a roller assembly 38 is supported. Each roller assembly again includes a circular roller 60 having a bottom edge 174 of a flexible material 54 secured thereto with the upper edge 176 of the flexible material being secured to an associated batten 172 in any suitable manner. In the disclosed embodiment, as seen best in FIG. 27, the batten has a longitudinal slot 176 formed therein so the edge 174 of the flexible material can be inserted and secured in the slot as with adhesive or the like. The rear vertical runs 66 of each cord ladder are fixed at their upper ends in the head rail and the front vertical runs are connected to a take-up roller (not seen) in a head rail which is again rotatable in one direction by pulling downwardly on a control cord secured to a tassel with the control cord being securable in any position in a cord lock of the type described previously. The take-up roller can rotate in the opposite direction due to the gravitational forces on the components of the covering to extend the covering once it has been partially or fully lifted by pulling downwardly on the tassel for the front vertical run of the cord ladder. As in the previously described embodiments, when the movable vertical run of the cord ladder is lifted, in this instance the front vertical run 64, it lifts the roller 60 of each roller assembly 38 thereby forcing the strip 54 connected thereto to be wrapped around the roller until the fabric is wrapped around the roller to a desired degree. Of course by lowering the front vertical run of the cord ladder, the rollers are allowed to drop by gravity unrolling the flexible material from the roller.

Pursuant to the above, it will be appreciated the concept of providing strips of flexible material that are anchored along an upper edge at a fixed location and secured to a roller at a bottom edge is described. The roller is raised or lowered by a cord ladder or similar structure which causes the roller to wrap the fabric therearound as one side of the cradle in which the roller is supported is lifted and allows the strip material to be unwound from the roller as the roller is dropped with the cradle. This assembly and its mode of operation can be incorporated into various covering products that include other sheets of covering material or no additional covering components at all.

For purposes of the present disclosure, reference to a sheet of material can include one homogenous sheet of material or a plurality of integrated strips of the same or different materials.

Although the present invention has been described with a certain degree of particularity, it is understood the disclosure has been made by way of example, and changes in detail or structure may be made without departing from the spirit of the invention as defined in the appended claims.

The invention claimed is:

1. A covering for an architectural opening comprising in combination:

a roller, a strip of material having one edge secured to the roller whereby said strip can be wound about the roller or unwound therefrom, a support element to which an opposite edge of said strip can be secured, and at least one control system for rotating said roller in opposite directions, said control system including a fixed run member of a predetermined length, a movable run member that is reversibly movable in a direction parallel with said fixed run member while said fixed run member remains extended to said predetermined length, and a flexible support member directly connecting said fixed and movable run members, said flexible support member forming a cradle for supporting said roller whereby movement of said movable run member in one direction or the other relative to said fixed run member causes said strip to be wound about or unwound from said roller.

2. The covering of claim 1 wherein there are a plurality of said rollers, strips of material and support elements, and further where there are a corresponding number of said flexible support members to said rollers, said support members being spaced along the length of said fixed and movable run members.

3. The covering of claim 2 wherein said flexible support members are cords.

4. The covering of claim 2 wherein said flexible support members are strips of material.

5. The covering of claim 4 wherein said strips of material have a width less than the length of said rollers.

6. The covering of claim 4 wherein said strips of material have a width approximating the length of a roller.

7. The covering of claim 2 wherein said fixed and movable run members are cords.

8. The covering of claim 2 wherein at least one of said fixed or movable run members is a cord.

9. The covering of claim 2 wherein at least one of said fixed or movable run members is a sheet of material.

10. The covering of claim 9 wherein both of said fixed and movable run members are sheets of material.

11. The covering of claim 2 wherein one of said fixed or movable run members is a strip of material.

12. The covering of claim 2 wherein said fixed run member is a sheet of material, said movable run member is a cord and said flexible support members are cords.

13. The covering of claim 2 further including a sheet of material disposed in parallel relationship with said fixed and vertical run members.

14. The covering of claim 13 wherein said sheet of material has a width substantially corresponding to the length of said rollers and a length substantially corresponding to the length of said fixed run member.

15. The covering of claim 14 wherein said support elements are secured to said sheet of material at spaced locations.

16. The covering of claim 15 wherein said sheet of material has a plurality of spaced loops formed thereon.

17. The covering of claim 15 further including a second control system for extending and retracting said sheet of material and said rollers.

18. The covering of claim 17 wherein said second control system includes a plurality of lift cords forming loops around said sheet of material and said rollers, and a movable tassel connected to said lift cords such that said loops of lift cords can be enlarged to move said covering to an extended position or reduced to move said covering to a retracted position.

19. The covering of claim 18 further including a rail secured to an edge of said flexible sheet, said loops of lift cord being slidably connected to said rail.

20. The covering of claim 19 wherein said movable run member includes a plurality of guide loops through which said lift cord loops slidably pass.

21. The covering of claim 19 wherein said support elements include brackets through which said lift cord loops slidably pass.

22. A covering for an architectural opening comprising a plurality of side-by-side coverings as defined in claim 2.

23. The covering of claim 2 wherein said support elements are suspended from said fixed run member.

24. The covering of claim 23 wherein said fixed run member includes a plurality of cord loops for suspending said support elements.

25. The covering of claim 2 wherein said control system further includes a roller secured to one end of said movable run member and an operating system for reversible rotating said roller such that said movable run member can be wound around or unwound from said roller to move said movable run member.

* * * * *